US011131153B2

(12) United States Patent
Reese et al.

(10) Patent No.: US 11,131,153 B2
(45) Date of Patent: Sep. 28, 2021

(54) POLYCRYSTALLINE DIAMOND TUBULAR PROTECTION

(71) Applicant: XR DOWNHOLE, LLC, Houston, TX (US)

(72) Inventors: Michael R. Reese, Houston, TX (US); David P. Miess, Spring, TX (US); Gregory Prevost, Spring, TX (US)

(73) Assignee: XR Downhole, LLC, Houston, TX (US)

( * ) Notice: Subject to any disclaimer, the term of this patent is extended or adjusted under 35 U.S.C. 154(b) by 0 days.

(21) Appl. No.: 16/529,310

(22) Filed: Aug. 1, 2019

(65) Prior Publication Data

US 2020/0063503 A1 Feb. 27, 2020

Related U.S. Application Data

(60) Provisional application No. 62/713,681, filed on Aug. 2, 2018.

(51) Int. Cl.
*E21B 17/10* (2006.01)

(52) U.S. Cl.
CPC ..... *E21B 17/1071* (2013.01); *E21B 17/1007* (2013.01); *E21B 17/1064* (2013.01)

(58) Field of Classification Search
CPC ..... E21B 17/1071
See application file for complete search history.

(56) References Cited

U.S. PATENT DOCUMENTS 1,798,604 A 3/1931 Hoke
1,963,956 A 6/1934 James
2,259,023 A 10/1941 Clark
(Continued)

FOREIGN PATENT DOCUMENTS

CA 2891268 A1 11/2016
JP 06174051 A 6/1994
(Continued)

OTHER PUBLICATIONS

Element six, The Element Six CVD Diamond Handbook, Accessed on Nov. 1, 2019, 28 pages.
(Continued)

*Primary Examiner* — Kristyn A Hall
(74) *Attorney, Agent, or Firm* — Michael S. McCoy; Amatong McCoy LLC

(57) ABSTRACT

A tubular engagement interface for interfacing the coupling of two movably engaged tubulars is disclosed. The tubular engagement interface includes a body. The body includes a body engagement surface. A polycrystalline diamond element is coupled with the body, and includes a diamond engagement surface. The tubular engagement interface may be coupled with an inner wall of a first tubular, such that the body engagement surface, the diamond engagement surface, or combinations thereof are engaged with an opposing engagement surface of an outer wall of a second tubular. Alternatively, the tubular engagement interface may be coupled with the outer wall of the second tubular, such that the body engagement surface, the diamond engagement surface, or combinations thereof are engaged with an opposing engagement surface of the inner wall of the first tubular.

29 Claims, 8 Drawing Sheets

(56) References Cited

U.S. PATENT DOCUMENTS 2,299,978 A 10/1942 Hall
2,407,586 A 9/1946 Summers
2,567,735 A 9/1951 Scott
2,693,396 A 11/1954 Gondek
2,758,181 A 8/1956 Crouch
2,788,677 A 4/1957 Hayek
2,877,662 A 3/1959 Eduard
2,897,016 A 7/1959 Baker
2,947,609 A 8/1960 Strong
2,947,610 A 8/1960 Hall et al.
3,559,802 A 2/1971 Eidus
3,582,161 A 6/1971 Hudson
3,603,652 A 9/1971 Youden
3,650,714 A 3/1972 Farkas
3,697,141 A 10/1972 Garrett
3,707,107 A 12/1972 Bieri
3,741,252 A 6/1973 Williams
3,745,623 A 7/1973 Wentorf et al.
3,752,541 A 8/1973 Mcvey
3,866,987 A 2/1975 Gamer
3,869,947 A 3/1975 Vandenkieboom
3,920,290 A 11/1975 Evarts
4,085,634 A 4/1978 Sattler
4,182,537 A 1/1980 Oster
4,225,322 A 9/1980 Knemeyer
4,238,137 A 12/1980 Furchak et al.
4,285,550 A 8/1981 Blackburn et al.
4,364,136 A 12/1982 Hattan
4,398,772 A 8/1983 Odell
4,410,054 A 10/1983 Nagel et al.
4,410,284 A 10/1983 Herrick
4,428,627 A 1/1984 Teramachi
4,432,682 A 2/1984 McKewan
4,468,138 A 8/1984 Nagel
4,554,208 A 11/1985 MacIver et al.
4,560,014 A 12/1985 Geczy
4,620,601 A 11/1986 Nagel
RE32,380 E 3/1987 Wentorf, Jr. et al.
4,662,348 A 5/1987 Hall et al.
4,679,639 A 7/1987 Barr et al.
4,689,847 A 9/1987 Huber
4,720,199 A 1/1988 Geczy et al.
4,729,440 A 3/1988 Hall
4,732,490 A 3/1988 Masciarelli
4,764,036 A * 8/1988 McPherson ..... E21B 4/003 175/320
4,796,670 A 1/1989 Russell et al.
4,797,011 A 1/1989 Saeki et al.
4,858,688 A 8/1989 Edwards et al.
4,906,528 A 3/1990 Cerceau et al.
4,958,692 A 9/1990 Anderson
5,011,514 A 4/1991 Cho et al.
5,011,515 A 4/1991 Frushour
5,030,276 A 7/1991 Sung et al.
5,037,212 A 8/1991 Justman et al.
5,066,145 A 11/1991 Sibley et al.
5,067,826 A 11/1991 Lemelson
5,092,687 A 3/1992 Hall
5,112,146 A 5/1992 Stangeland
5,123,772 A 6/1992 Anderson
5,151,107 A 9/1992 Cho et al.
5,176,483 A 1/1993 Baumann et al.
5,193,363 A 3/1993 Petty
5,205,188 A 4/1993 Repenning et al.
5,253,939 A 10/1993 Hall
5,271,749 A 12/1993 Rai et al.
5,351,770 A 10/1994 Cawthorne et al.
5,358,041 A 10/1994 O'Hair
5,358,337 A 10/1994 Codatto
5,375,679 A 12/1994 Biehl
5,385,715 A 1/1995 Fish
5,447,208 A 9/1995 Lund et al.
5,462,362 A 10/1995 Yuhta et al.
5,464,086 A 11/1995 Coelln
5,522,467 A 6/1996 Stevens et al.
5,533,604 A 7/1996 Brierton
5,538,346 A 7/1996 Frias et al.
5,540,314 A 7/1996 Coelln
5,560,716 A 10/1996 Tank et al.
5,618,114 A 4/1997 Katahira
5,645,617 A 7/1997 Frushour
5,653,300 A 8/1997 Lund et al.
5,715,898 A 2/1998 Anderson
5,833,019 A 11/1998 Gynz-Rekowski
5,855,996 A 1/1999 Corrigan et al.
5,948,541 A 9/1999 Inspektor
6,045,029 A 4/2000 Scott
6,109,790 A 8/2000 Gynz-Rekowski et al.
6,120,185 A 9/2000 Masciarelli, Jr.
6,129,195 A 10/2000 Matheny
6,152,223 A 11/2000 Abdo et al.
6,164,109 A 12/2000 Bartosch
6,209,185 B1 4/2001 Scott
6,279,716 B1 8/2001 Kayatani et al.
6,378,633 B1 4/2002 Moore et al.
6,409,388 B1 6/2002 Lin
6,457,865 B1 10/2002 Masciarelli, Jr.
6,488,103 B1 12/2002 Dennis et al.
6,488,715 B1 12/2002 Pope et al.
6,516,934 B2 2/2003 Masciarelli, Jr.
6,652,201 B2 11/2003 Kunimori et al.
6,655,845 B1 12/2003 Pope et al.
6,737,377 B1 5/2004 Sumiya et al.
6,764,219 B2 7/2004 Doll et al.
6,808,019 B1 10/2004 Mabry
6,814,775 B2 11/2004 Scurlock et al.
6,951,578 B1 10/2005 Belnap et al.
7,007,787 B2 3/2006 Pallini et al.
7,198,043 B1 4/2007 Zhang
7,234,541 B2 6/2007 Scott et al.
7,441,610 B2 10/2008 Belnap et al.
7,475,744 B2 1/2009 Pope
7,552,782 B1 6/2009 Sexton et al.
7,703,982 B2 4/2010 Cooley
7,737,377 B1 6/2010 Dodal et al.
7,845,436 B2 12/2010 Cooley et al.
7,861,805 B2 1/2011 Dick et al.
7,870,913 B1 1/2011 Sexton et al.
8,069,933 B2 12/2011 Sexton et al.
8,109,247 B2 2/2012 Wakade et al.
8,119,240 B2 2/2012 Cooper
8,163,232 B2 4/2012 Fang et al.
8,277,124 B2 10/2012 Sexton et al.
8,277,722 B2 10/2012 DiGiovanni
8,365,846 B2 2/2013 Dourfaye et al.
8,480,304 B1 7/2013 Cooley et al.
8,485,284 B2 7/2013 Sithebe
8,613,554 B2 12/2013 Tessier et al.
8,627,904 B2 1/2014 Voronin
8,678,657 B1 3/2014 Knuteson et al.
8,701,797 B2 4/2014 Baudoin
8,734,550 B1 5/2014 Sani
8,757,299 B2 * 6/2014 DiGiovanni ..... E21B 10/567 175/428
8,763,727 B1 7/2014 Cooley et al.
8,764,295 B2 7/2014 Dadson et al.
8,881,849 B2 11/2014 Shen et al.
8,939,652 B2 1/2015 Peterson et al.
8,974,559 B2 3/2015 Frushour
9,004,198 B2 4/2015 Kulkarni
9,010,418 B2 4/2015 Pereyra et al.
9,045,941 B2 6/2015 Chustz
9,103,172 B1 8/2015 Bertagnolli et al.
9,127,713 B1 9/2015 Lu
9,145,743 B2 9/2015 Shen et al.
9,222,515 B2 12/2015 Chang
9,273,381 B2 3/2016 Qian et al.
9,353,788 B1 5/2016 Tulett et al.
9,366,085 B2 6/2016 Panahi
9,404,310 B1 8/2016 Sani et al.
9,410,573 B1 8/2016 Lu
9,429,188 B2 8/2016 Peterson et al.
9,488,221 B2 11/2016 Gonzalez
9,562,562 B2 2/2017 Peterson

(56) References Cited

U.S. PATENT DOCUMENTS

| | | | |
|---|---|---|---|
| 9,643,293 | B1 | 5/2017 | Miess et al. |
| 9,702,401 | B2 | 7/2017 | Gonzalez |
| 9,732,791 | B1 | 8/2017 | Gonzalez |
| 9,776,917 | B2 | 10/2017 | Tessitore et al. |
| 9,790,749 | B2 | 10/2017 | Chen |
| 9,790,818 | B2 | 10/2017 | Berruet et al. |
| 9,803,432 | B2 | 10/2017 | Wood et al. |
| 9,822,523 | B1 | 11/2017 | Miess |
| 9,840,875 | B2 | 12/2017 | Harvey et al. |
| 9,869,135 | B1 | 1/2018 | Martin |
| 10,113,362 | B2 | 10/2018 | Ritchie et al. |
| 10,294,986 | B2 | 5/2019 | Gonzalez |
| 10,307,891 | B2 | 6/2019 | Daniels et al. |
| 10,408,086 | B1 | 9/2019 | Meier |
| 10,465,775 | B1 | 11/2019 | Miess et al. |
| 10,683,895 | B2 | 6/2020 | Hall et al. |
| 10,711,792 | B2 | 7/2020 | Vidalenc et al. |
| 10,738,821 | B2 | 8/2020 | Miess et al. |
| 10,807,913 | B1 | 10/2020 | Hawks et al. |
| 2002/0020526 | A1 | 2/2002 | Male et al. |
| 2003/0019106 | A1 | 1/2003 | Pope et al. |
| 2003/0075363 | A1 | 4/2003 | Lin et al. |
| 2003/0159834 | A1 | 8/2003 | Kirk et al. |
| 2004/0031625 | A1 | 2/2004 | Lin et al. |
| 2004/0163822 | A1 | 8/2004 | Zhang et al. |
| 2004/0219362 | A1 | 11/2004 | Wort et al. |
| 2004/0223676 | A1 | 11/2004 | Pope et al. |
| 2006/0060392 | A1 | 3/2006 | Eyre |
| 2006/0165973 | A1 | 7/2006 | Dumm et al. |
| 2007/0046119 | A1 | 3/2007 | Cooley |
| 2008/0217063 | A1* | 9/2008 | Moore ..... E21B 17/1057 175/57 |
| 2008/0253706 | A1 | 10/2008 | Bischof et al. |
| 2009/0020046 | A1 | 1/2009 | Marcelli |
| 2009/0087563 | A1 | 4/2009 | Voegele et al. |
| 2009/0268995 | A1 | 10/2009 | Ide et al. |
| 2010/0037864 | A1 | 2/2010 | Dutt et al. |
| 2010/0276200 | A1* | 11/2010 | Schwefe ..... E21B 10/43 175/57 |
| 2010/0307069 | A1 | 12/2010 | Bertagnolli et al. |
| 2011/0174547 | A1 | 7/2011 | Sexton et al. |
| 2011/0203791 | A1 | 8/2011 | Jin et al. |
| 2011/0220415 | A1 | 9/2011 | Jin et al. |
| 2011/0297454 | A1 | 12/2011 | Shen et al. |
| 2012/0037425 | A1 | 2/2012 | Sexton et al. |
| 2012/0057814 | A1 | 3/2012 | Dadson et al. |
| 2012/0225253 | A1 | 9/2012 | DiGiovanni et al. |
| 2012/0281938 | A1 | 11/2012 | Peterson et al. |
| 2013/0000442 | A1 | 1/2013 | Wiesner et al. |
| 2013/0004106 | A1 | 1/2013 | Wenzel |
| 2013/0146367 | A1 | 6/2013 | Zhang et al. |
| 2013/0170778 | A1 | 7/2013 | Higginbotham et al. |
| 2014/0037232 | A1 | 2/2014 | Marchand et al. |
| 2014/0176139 | A1 | 6/2014 | Espinosa et al. |
| 2014/0254967 | A1 | 9/2014 | Gonzalez |
| 2014/0341487 | A1 | 11/2014 | Cooley et al. |
| 2014/0355914 | A1 | 12/2014 | Cooley et al. |
| 2015/0027713 | A1 | 1/2015 | Penisson |
| 2015/0132539 | A1 | 5/2015 | Bailey et al. |
| 2016/0153243 | A1 | 6/2016 | Hinz et al. |
| 2016/0312535 | A1 | 10/2016 | Ritchie et al. |
| 2017/0030393 | A1 | 2/2017 | Phua et al. |
| 2017/0138224 | A1 | 5/2017 | Henry et al. |
| 2017/0234071 | A1 | 8/2017 | Spatz et al. |
| 2017/0261031 | A1 | 9/2017 | Gonzalez et al. |
| 2018/0087134 | A1 | 3/2018 | Chang et al. |
| 2018/0209476 | A1 | 7/2018 | Gonzalez |
| 2018/0216661 | A1 | 8/2018 | Gonzalez |
| 2018/0264614 | A1 | 9/2018 | Winkelmann et al. |
| 2019/0063495 | A1 | 2/2019 | Peterson et al. |
| 2019/0136628 | A1 | 5/2019 | Savage et al. |
| 2019/0170186 | A1 | 6/2019 | Gonzalez et al. |
| 2020/0031586 | A1 | 1/2020 | Miess et al. |
| 2020/0032841 | A1 | 1/2020 | Miess et al. |
| 2020/0032846 | A1 | 1/2020 | Miess et al. |
| 2020/0056659 | A1 | 2/2020 | Prevost et al. |
| 2020/0182290 | A1 | 6/2020 | Doehring et al. |

FOREIGN PATENT DOCUMENTS

| | | | |
|---|---|---|---|
| WO | 2004001238 | A2 | 12/2003 |
| WO | 2006028327 | A1 | 3/2006 |
| WO | 2017105883 | A1 | 6/2017 |
| WO | 2018041578 | A1 | 3/2018 |
| WO | 2018226380 | A1 | 12/2018 |
| WO | 2019096851 | A1 | 5/2019 |

OTHER PUBLICATIONS

Grossman, David, What the World Needs Now is Superhard Carbon, Popular Mechanics, https://www.popularmechanics.com/science/environment/a28970718/superhard-materials/, Sep. 10, 2019, 7 pages, Hearst Magazine Media, Inc.

Machinery's Handbook, 2016, Industrial Press, INC., 30th edition, pp. 843 and 1055 (6 pages total).

Superhard Material, Wikipedia, https://en.wikipedia.org/wiki/Superhard_material, Retrieved from https://en.wikipedia.org/w/index.php?title=Superhard_material&oldid=928571597, Nov. 30, 2019, 14 pages.

Surface Finish, Wikipedia, https://en.wikipedia.org/wiki/Surface_finish,Retrieved from https://en.wikipedia.org/w/index.php?title=Surface_finish&oldid=919232937, Oct. 2, 2019, 3 pages.

Zeidan, Fouad Y.; Paquette, Donald J., Application of High Speed and High Performance Fluid Film Bearings in Rotating Machinery, 1994, pp. 209-234.

International Search Report and Written Opinion dated Aug. 3, 2020 (issued in PCT Application No. PCT/US20/21549) [11 pages].

International Search Report and Written Opinion dated Aug. 4, 2020 (issued in PCT Application No. PCT/US2020/034437) [10 pages].

International Search Report and Written Opinion dated Sep. 2, 2020 (issued in PCT Application No. PCT/US20/37048) [8 pages].

International Search Report and Written Opinion dated Sep. 8, 2020 (issued in PCT Application No. PCT/US20/35316) [9 pages].

International Search Report and Written Opinion dated Sep. 9, 2020 (issued in PCT Application No. PCT/US20/32196) [13 pages].

Linear Rolling Bearings ME EN 7960—Precision Machine Design Topic 8, Presentation, Accessed on Jan. 26, 2020, 23 Pages, University of Utah.

Linear-motion Bearing, Wikipedia, https://en.wikipedia.org/w/index.php?title=Linear-motion_bearing&oldid=933640111, Jan. 2, 2020, 4 Pages.

Bovenkerk, Dr. H. P.; Bundy, Dr. F. P.; Hall, Dr. H. T.; Strong, Dr. H. M.; Wentorf, Jun., Dr. R. H.; Preparation of Diamond, Nature, Oct. 10, 1959, pp. 1094-1098, vol. 184.

Chen, Y.; Nguyen, T; Zhang, L.C.; Polishing of polycrystalline diamond by the technique of dynamic friction—Part 5: Quantitative analysis of material removal, International Journal of Machine Tools & Manufacture, 2009, pp. 515-520, vol. 49, Elsevier.

Chen, Y.; Zhang, L.C.; Arsecularatne, J.A.; Montross, C.; Polishing of polycrystalline diamond by the technique of dynamic friction, part 1: Prediction of the interface temperature rise, International Journal of Machine Tools & Manufacture, 2006, pp. 580-587, vol. 46, Elsevier.

Chen, Y.; Zhang, L.C.; Arsecularatne, J.A.; Polishing of polycrystalline diamond by the technique of dynamic friction. Part 2: Material removal mechanism, International Journal of Machine Tools & Manufacture, 2007, pp. 1615-1624, vol. 47, Elsevier.

Chen, Y.; Zhang, L.C.; Arsecularatne, J.A.; Zarudi, I., Polishing of polycrystalline diamond by the technique of dynamic friction, part 3: Mechanism exploration through debris analysis, International Journal of Machine Tools & Manufacture, 2007, pp. 2282-2289, vol. 47, Elsevier.

Chen, Y.; Zhang, L.C.; Polishing of polycrystalline diamond by the technique of dynamic friction, part 4: Establishing the polishing map, International Journal of Machine Tools & Manufacture, 2009, pp. 309-314, vol. 49, Elsevier.

(56) References Cited

OTHER PUBLICATIONS

Dobrzhinetskaya, Larissa F.; Green, II, Harry W.; Diamond Synthesis from Graphite in the Presence of Water and SiO2: Implications for Diamond Formation in Quartzites from Kazakhstan, International Geology Review, 2007, pp. 389-400, vol. 49.
Hudson Bearings Air Cargo Ball Transfers brochure, 8 Pages, Columbus, Ohio.
Hudson Bearings Air Cargo Ball Transfers Installation and Maintenance Protocols, pp. 1-5.
International Search Report and Written Opinion dated Oct. 21, 2019 (issued in PCT Application No. PCT/US2019/043746) [14 pages].
International Search Report and Written Opinion dated Oct. 22, 2019 (issued in PCT Application No. PCT/US2019/043744) [11 pages].
International Search Report and Written Opinion dated Oct. 25, 2019 (issued in PCT Application No. PCT/US2019/044682) [20 pages].
International Search Report and Written Opinion dated Oct. 29, 2019 (issued in PCT Application No. PCT/US2019/043741) [15 pages].
International Search Report and Written Opinion dated Sep. 9, 2019 (issued in PCT Application No. PCT/US2019/043732) [10 pages].
Liao, Y.; Marks, L.; In situ single asperity wear at the nanometre scale, International Materials Reviews, 2016, pp. 1-17, Taylor & Francis.
Machinery's Handbook 30th Edition, Copyright Page and Coefficients of Friction Page, 2016, p. 158 (2 Pages total), Industrial Press, Inc., South Norwalk, U.S.A.
McCarthy, J. Michael; Cam and Follower Systems, PowerPoint Presentation, Jul. 25, 2009, pp. 1-14, UClrvine The Henry Samueli School of Engineering.
McGill Cam Follower Bearings brochure, 2005, p. 1-19, Back Page, Brochure MCCF-05, Form #8991 (20 Pages total).
Motion & Control NSK Cam Followers (Stud Type Track Rollers) Roller Followers (Yoke Type Track Rollers) catalog, 1991, Cover Page, pp. 1-18, Back Page, CAT. No. E1421 2004 C-11, Japan.
Product Catalogue, Asahi Diamond Industrial Australia Pty. Ltd., Cover Page, Blank Page, 2 Notes Pages, Table of Contents, pp. 1-49 (54 Pages total).
RBC Aerospace Bearings Rolling Element Bearings catalog, 2008, Cover Page, First Page, pp. 1-149, Back Page (152 Pages total).
RGPBalls Ball Transfer Units catalog, pp. 1-26, 2 Back Pages (28 Pages total).
Sandvik Coromant Hard part turning with CBN catalog, 2012, pp. 1-42, 2 Back Pages (44 Pages total).
Sexton, Timothy N.; Cooley, Craig H.; Diamond Bearing Technology for Deep and Geothermal Drilling, PowerPoint Presentation, 2010, 16 Pages.
SKF Ball transfer units catalog, Dec. 2006, Cover Page, Table of Contents, pp. 1-36, 2 Back Pages (40 Pages total), Publication 940-711.
Sowers, Jason Michael, Examination of the Material Removal Rate in Lapping Polycrystalline Diamond Compacts, A Thesis, Aug. 2011, 2 Cover Pages, pp. iii-xiv, pp. 1-87 (101 Pages total).
Sun, Liling; Wu, Qi; Dai, Daoyang; Zhang, Jun; Qin, Zhicheng; Wang, Wenkui; Non-metallic catalysts for diamond synthesis under high pressure and high temperature, Science in China (Series A), Aug. 1999, pp. 834-841, vol. 42 No. 8, China.
United States Defensive Publication No. T102,901, published Apr. 5, 1983, in U.S. Appl. No. 298,271 [2 Pages].
USSynthetic Bearings and Waukesha Bearings brochure for Diamond Tilting Pad Thrust Bearings, 2015, 2 Pages.
USSynthetic Bearings brochure, 12 Pages, Orem, Utah.
Zhigadlo, N. D., Spontaneous growth of diamond from MnNi solvent-catalyst using opposed anvil-type high-pressure apparatus, pp. 1-12, Laboratory for Solid State Physics, Switzerland.
Zou, Lai; Huang, Yun; Zhou, Ming; Xiao, Guijian; Thermochemical Wear of Single Crystal Diamond Catalyzed by Ferrous Materials at Elevated Temperature, Crystals, 2017, pp. 1-10, vol. 7.
International Search Report and Written Opinion dated Jan. 15, 2021 (issued in PCT Application No. PCT/US2020/049382) [18 pages].

* cited by examiner

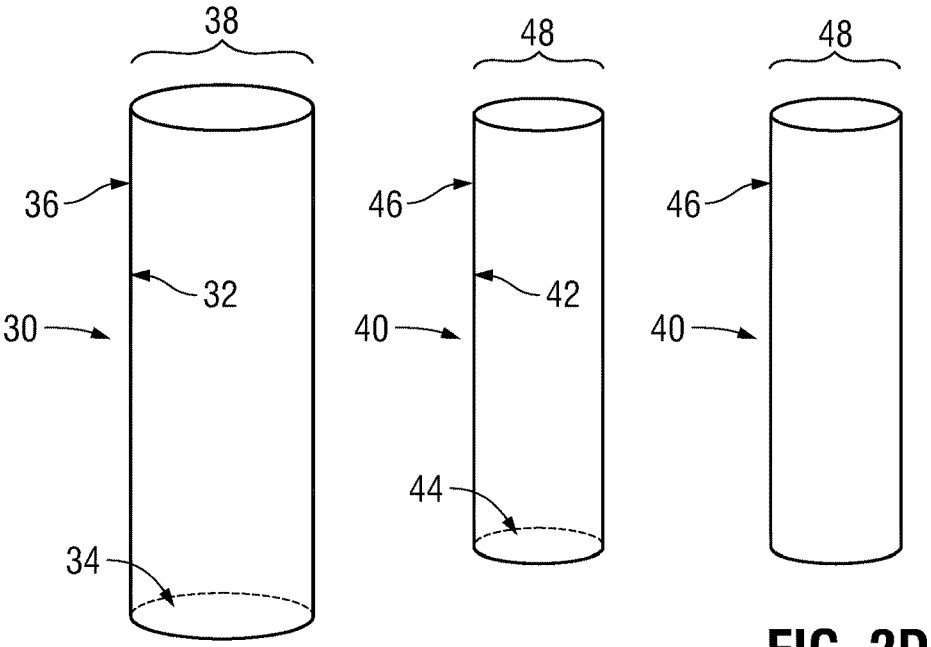
FIG. 2A
FIG. 2C
FIG. 2D
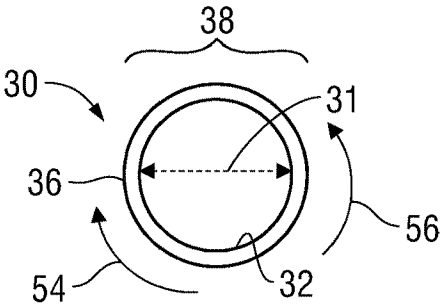
FIG. 2B
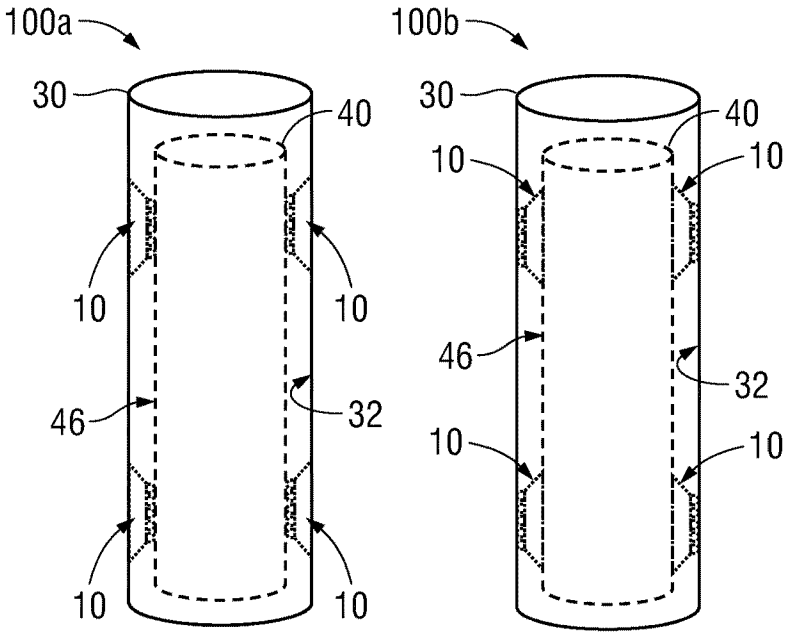
FIG. 2E
FIG. 2F

POLYCRYSTALLINE DIAMOND TUBULAR PROTECTION

CROSS-REFERENCE TO RELATED APPLICATIONS

The present application claims the benefit of U.S. Provisional Patent Application No. 62/713,681, filed on Aug. 2, 2018, entitled "Polycrystalline Diamond Tubular Protection", the entirety of which is incorporated herein by reference.

STATEMENT REGARDING FEDERALLY SPONSORED RESEARCH OF DEVELOPMENT

Not applicable.

FIELD

The present disclosure relates to polycrystalline diamond elements for use as protection between tubulars that are movably engaged with one another; to apparatus and systems including the same; and to methods of making, assembling, and using the same.

BACKGROUND

Several downhole oil well construction and production applications involve relatively smaller diameter tubulars movably coupled (e.g., in sliding, rotating, and/or reciprocating engagement) with (e.g., inside) relatively larger diameter tubulars. These applications include, but are not limited to, a drill pipe string operating inside casing and a sucker rod string operating inside production tubing.

Wear on the internal diameter of the relatively larger, outer tubular and on the outer diameter of the relatively smaller, inner tubular, especially at the upset coupling or connection diameters of the inner pipe or sucker rod, is frequently problematic. These wear problems are accelerated in directionally drilled wells where gravity causes the inner tubular and its connections to engage with and "ride" on the inner, low-side of the larger diameter tubular (e.g., casing or production tubing). Additionally, wells with relatively high deviation changes create rub points for the interface of the inner and outer tubulars.

In drilling operations, such wear can lead to failed drill string and loss of the drill string below the failure. Such wear can also cause problems to the integrity of the well due to casing wear. In production operations, such wear can lead to failure of the sucker rod string or cause wear of the production tubing. A production tubing failure causes the operator to have to prematurely service the well, adding cost and losing production.

Over time, technology has been developed to reduce the contact and wear at the interface of the inner and outer tubulars by attaching sacrificial protectors or guides at intervals around the outer surface of the inner tubular string. In drilling applications, these sacrificial protectors or guides are typically referred to as "pipe protectors". In production applications, these sacrificial protectors or guides are typically referred to as "rod guides". In both drilling and production applications, these sacrificial protectors or guides are typically made from molded rubber, nylon, plastic, polymer, polyurethane, synthetic polyamide, or polyether ether ketone (PEEK). Pipe protectors typically are mounted on a metal frame. Rod guides may be molded directly onto the rod lengths and may or may not include a metal frame.

With any of the materials currently used for sacrificial protectors or guides, relatively higher temperatures result in an increase in the rate of abrasive wear of the sacrificial protectors or guides.

Replacing drill pipe, sucker rod strings, and/or production tubing is expensive and time consuming. In the case of production applications, the avoidance of wear problems involves working over the well to replace guides and clear debris from the production tubing. In so called unconventional wells, the frequency of workovers to replace sucker rod guides can be as often as every three months.

What is needed is a technology to extend the lifespan of pipe protectors and rod guides without increasing or significantly increasing the coefficient of friction of the engagement of the protectors/guides with the outer tubulars.

Polycrystalline diamond elements have, in the past, been contraindicated for engagement with the inner surfaces of casing or production tubing. Without being bound by theory, polycrystalline diamond, including thermally stable polycrystalline diamond and polycrystalline diamond compact, has been considered as contraindicated for use in the engagement with ferrous metals, and other metals, metal alloys, composites, hardfacings, coatings, or platings that contain more than trace amounts of diamond catalyst or solvent elements including cobalt, nickel, ruthenium, rhodium, palladium, chromium, manganese, copper, titanium, or tantalum. Further, this prior contraindication of the use of polycrystalline diamond extends to so called "superalloys", including iron-based, cobalt-based and nickel-based superalloys containing more than trace amounts of diamond catalyst or solvent elements. The surface speeds typically used in machining of such materials typically ranges from about 0.2 m/s to about 5 m/s. Although these surface speeds are not particularly high, the load and attendant temperature generated, such as at a cutting tip, often exceeds the graphitization temperature of diamond (i.e., about 700° C.), which can, in the presence of diamond catalyst or solvent elements, lead to rapid wear and failure of components, such as diamond tipped tools. Without being bound by theory, the specific failure mechanism is believed to result from the chemical interaction of the carbon bearing diamond with the carbon attracting material that is being machined. An exemplary reference concerning the contraindication of polycrystalline diamond for diamond catalyst or solvent containing metal or alloy machining is U.S. Pat. No. 3,745,623, which is incorporated herein by reference in its entirety. The contraindication of polycrystalline diamond for machining diamond catalyst or solvent containing materials has long caused the avoidance of the use of polycrystalline diamond in all contacting applications with such materials. Copper and titanium were not typically listed in the early General Electric documentation on diamond synthesis but have been added later. Relevant references include "Diamond Synthesis from Graphite in the Presence of Water and $SiO_2$"; Dobrzhinetskaya and Green, II International Geology Review Vol. 49, 2007 and "Non-metallic catalysts for diamond synthesis under high pressure and high temperature", Sun et al, Science in China August 1999. Additional significant references that inform the background of the technology of this application are from the International Journal of Machine Tools & Manufacture 46 and 47 titled "Polishing of polycrystalline diamond by the technique of dynamic friction, part 1: Prediction of the interface temperature rise" and "Part 2, Material removal mechanism" 2005 and 2006. These references report on the dynamic friction polishing of PDC faces utilizing dry sliding contact under load with a carbon attractive steel disk. Key findings in these references indicate that polishing rate is more sensitive to sliding rate than load and that the rate of thermo-chemical reaction between the steel disk and the diamond surface reduces significantly as the surface finish of the diamond surface improves. The authors also reference prior conclusions that the thermo-chemical reaction between the steel disk and the PDC face does not occur at sliding speeds below 10.5 m/s at a pressure of 27 MPa. These references are incorporated herein by reference, as if set out in full.

BRIEF SUMMARY

One embodiment of the present disclosure includes a tubular assembly. The tubular assembly includes a first tubular, including an outer wall, an inner wall, and a hollow that is at least partially defined by the inner wall. The tubular assembly includes a second tubular, including an outer wall. The second tubular is movably engaged within the first tubular, such that the second tubular is at least partially positioned within the hollow of the first tubular. The tubular assembly includes a tubular engagement interface, including a body. The body includes a body engagement surface. A polycrystalline diamond element is coupled with the body. The polycrystalline diamond element includes a diamond engagement surface. The tubular engagement interface is either coupled with the inner wall of the first tubular such that the body engagement surface, the diamond engagement surface, or combinations thereof are engaged with an opposing engagement surface of the outer wall of the second tubular; or, the tubular engagement interface is coupled with the outer wall of the second tubular such that the body engagement surface, the diamond engagement surface, or combinations thereof are engaged with an opposing engagement surface of the inner wall of the first tubular.

Another embodiment of the present disclosure includes a tubular that is configured for movable engagement with another tubular. The tubular includes a tubular body and a tubular wall. A tubular engagement interface is coupled with the tubular wall and extends from the tubular body. The tubular engagement interface includes a body, including a body engagement surface. A polycrystalline diamond element is coupled with the body, and includes a diamond engagement surface.

Another embodiment of the present disclosure includes a tubular engagement interface for interfacing the engagement of two different tubulars. The tubular engagement interface includes a body, including a body engagement surface. A polycrystalline diamond element is coupled with the body, and includes a diamond engagement surface.

Another embodiment of the present disclosure includes a method of engaging tubulars. The method includes movably engaging a second tubular within a hollow of a first tubular. The first tubular includes an outer wall and an inner wall that at least partially defines the hollow. The second tubular includes an outer wall. The method includes interfacing the engagement between the first tubular and the second tubular with a tubular engagement interface. The tubular engagement interface includes a body, including a body engagement surface. A polycrystalline diamond element is coupled with the body, and includes a diamond engagement surface. Interfacing the engagement between the first tubular and the second tubular includes engaging the body engagement surface, the diamond engagement surface, or combinations thereof with an opposing engagement surface of either the second tubular or the first tubular.

BRIEF DESCRIPTION OF THE DRAWINGS

So that the manner in which the features and advantages of the systems, apparatus, and/or methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

FIG. 2A is a perspective view of a hollow tubular.

FIG. 2B is an end view of the hollow tubular of FIG. 2A.

FIG. 2C is a perspective view of a hollow tubular having a smaller diameter than that of FIG. 2A.

FIG. 2D is a perspective view of a solid tubular.

FIG. 2E is a perspective view of a relatively smaller diameter tubular movably engaged within a relative larger diameter tubular, with a tubular engagement interface coupled on the relatively larger diameter tubular and interfacing the engagement therebetween.

FIG. 2F is a perspective view of a relatively smaller diameter tubular movably engaged within a relatively larger diameter tubular, with a tubular engagement interface coupled on the relatively smaller diameter tubular and interfacing the engagement therebetween.

Systems, apparatus, and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain embodiments of the present disclosure include polycrystalline diamond elements for use as protection between tubulars that are movably engaged with one another; protectors or guides including the polycrystalline diamond elements; tubular assemblies including the protectors or guides; apparatus and systems including the tubular assemblies; and to methods of making, assembling, and using the polycrystalline diamond elements, the protectors or guides, the tubular assemblies, and the apparatus and systems.

Engagement Interface

Certain embodiments of the present disclosure include an engagement interface configured to interface the engagement of two different tubulars. With reference to FIGS. 1A-1D, exemplary engagement interfaces are depicted. Engagement interface 10 includes body 12. Body 12 may be or include a material such as metal, such as steel, or a polymer, such as a rubber or a plastic. Some exemplary polymers of which body 12 may be or include are nylon, polyurethane, polyamide (e.g., synthetic polyamide), or polyether ether ketone (PEEK). Body 12 is not limited to being or including any of these particular materials.

Figure 1A:
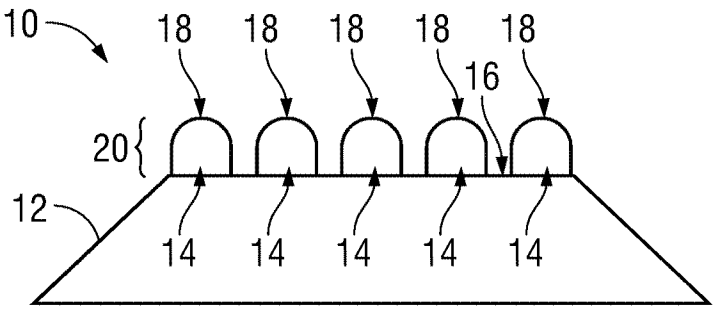
FIG. 1A is a side view of a tubular engagement interface including polycrystalline diamond elements extending above an engagement surface of a body of the tubular engagement interface.
Figure 1B:
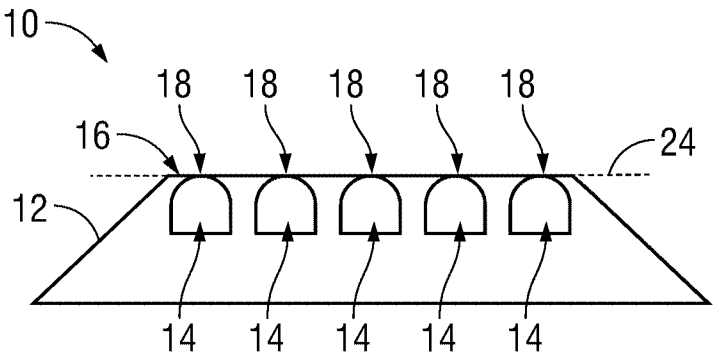
FIG. 1B is a side view of a tubular engagement interface including polycrystalline diamond elements that are flush with an engagement surface of a body of the tubular engagement interface.
Figure 1C:
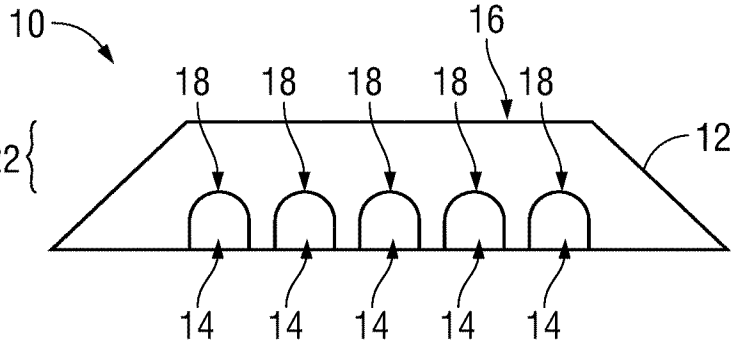
FIG. 1C is a side view of a tubular engagement interface including polycrystalline diamond elements positioned below an engagement surface of a body of the tubular engagement interface.
Figure 1D:
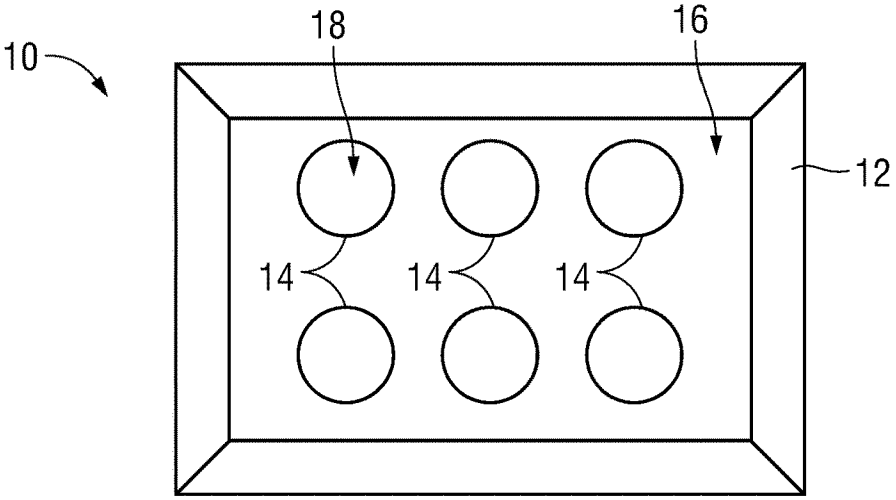
FIG. 1D is a top view of a tubular engagement interface including polycrystalline diamond elements.

Engagement interface 10 includes a plurality of polycrystalline diamond elements 14. Each polycrystalline diamond element 14 is coupled with body 12. For example, each polycrystalline diamond element 14 may be embedded within body 12 or otherwise coupled to body 12. In embodiments where body 12 is a polymer body, body 12 may be molded onto, over, or with polycrystalline diamond elements 14 via a polymer molding process. For example, FIGS. 1B and 1C show variations of polycrystalline diamond elements 14 embedded into body 12, with body 12 molded over polycrystalline diamond elements 14. In embodiments where body 12 is a metal body, polycrystalline diamond elements 14 may be attached to body 12, such as attached onto the surface of body 12 or attached within a machined recess in body 12. For example, FIG. 1A shows polycrystalline diamond elements 14 attached on top of body 12. In some embodiments, polycrystalline diamond elements 14 are static relative to body 12.

Body 12 includes body engagement surface 16, and each polycrystalline diamond element 14 includes a diamond engagement surface 18. As shown in FIG. 1A, in some embodiments polycrystalline diamond elements 14 extend above body engagement surface 16, such that diamond engagement surfaces 18 are positioned above body engagement surface 16 by first distance 20. In other embodiments, as shown in FIG. 1B, diamond engagement surfaces 18 are flush with body engagement surface 16, such that diamond engagement surfaces 18 lie in the same plane 24 as (i.e., are coplanar with) body engagement surface 16. In still other embodiments, as shown in FIG. 1C, body engagement surface 16 extends above diamond engagement surfaces 18, such that body engagement surface 16 is positioned above each of diamond engagement surfaces 18 by second distance 22. As used herein, "engagement surface" refers to the surface of a material (e.g., polycrystalline diamond or polymer or steel) that is positioned and arranged within an assembly (e.g., within a tubular assembly) such that, in operation of the assembly, the engagement surface interfaces contact between two tubulars of the tubular assembly. It would be understood by one skilled in the art that the diamond engagement surface and/or body engagement surface are not limited to being necessarily in constant engagement with the opposing engagement surface. Rather, the diamond engagement surface and/or body engagement surface are positioned such that one or both of the diamond engagement surface and/or body engagement surface will engage with the opposing engagement surface prior to direct, surface-to-surface engagement between the two tubulars.

Engagement interface 10 may provide protection at the interface of two different tubulars that are movably (e.g., slidingly and/or rotatably) engaged with one another. In some embodiments, engagement interface 10 is a drill pipe protector. In other embodiments, engagement interface 10 is a sucker rod guide. While shown and described herein as a drill pipe protector and a sucker rod guide, the engagement interface disclosed herein is not limited to being a drill pipe protector or a sucker rod guide, and may be another structure that is capable of being coupled with a tubular and interfacing movable engagement between that tubular and another tubular. In some embodiments, rather than being coupled with a tubular, the engagement interface is integral with the tubular. In some embodiments, the engagement interface is static relative to one tubular (i.e., the tubular to which the engagement interface is coupled), and is movably relative to the other tubular (i.e., is movably engaged with the other tubular).

Tubular Assemblies

Certain embodiments include tubular assemblies that include the engagement interfaces disclosed herein positioned to interface the engagement between the tubulars of the tubular assemblies. With reference to FIGS. 2A-2F, a first tubular and a second tubular are shown. The first and second tubulars may be, for example and without limitation, piping, casing, rods, tubing, or other tubulars.

Tubular 30 is a hollow tubular, such as a pipe or other conduit, having inner wall 32 defining cavity 34 therethrough, such as a pipe or other conduit. Tubular 30 has outer wall 36. Tubular 30 has an outer diameter 38 defined by outer wall 36, and an inner diameter 31 defined by inner wall 32.

In some embodiments, as shown in FIG. 2C, tubular 40 is a hollow tubular, such as a pipe or other conduit, having inner wall 42 defining cavity 44 therethrough. In other embodiments, as shown in FIG. 2D, tubular 40 is a solid tubular, such as rod, without a cavity or conduit defined therethrough. Tubular 40 has an outer wall 46, defining outer diameter 48 of tubular 40. Outer diameter 48 of tubular 40 and inner diameter 31 of tubular 30 are sized such that tubular 40 may be coupled or engaged at least partially within cavity 34 of tubular 30, as shown in FIG. 2E. That is, tubular 30 is a relatively larger diameter tubular, and tubular 40 is a relatively smaller diameter tubular, such that outer diameter 48 of tubular 40 is smaller than inner diameter 31 of tubular 30.

As shown in FIGS. 2E and 2F, tubular assemblies 100*a* and 100*b* each include tubulars 30 and 40, which are movably engaged with one another. Tubular 40 may slidingly engage within tubular 30 such that one or both of tubulars 30 and 40 are movable along one or both directions 50 and 52. As used herein, "slidingly engaged" refers to an engagement between at least two tubulars that allows at least one of the tubulars to slide relative to the other of the tubulars. For example, tubular 40 may slide within tubular 30 along one or both directions 50 and 52, tubular 30 may slide about tubular 40 along one or both directions 50 and 52, or combinations thereof.

Tubular 40 may rotatably engage within tubular 30 such that one or both of tubulars 30 and 40 are rotatable in one or both directions 54 and 56 (as shown in FIG. 2B). As used herein, "rotatably engaged" refers to an engagement between at least two tubulars that allows at least one of the tubulars to rotate relative to the other of the tubulars. For example, tubular 40 may rotate within tubular 30 along one or both directions 54 and 56, tubular 30 may rotate about tubular 40 along one or both directions 54 and 56, or combinations thereof.

Thus, tubular 40 may movably engaged within tubular 30 such that one or both of tubulars 30 and 40 are movable relative to the other tubular. As used herein, "movably engaged", in reference to engaged tubulars, refers to an engagement between at least two tubulars that allows at least one of the tubulars to move relative to the other of the tubulars. For example, tubular 40 may move (e.g., slide and/or rotate) relative to tubular 30, tubular 30 may move relative to tubular 40, or combinations thereof.

Engagement interfaces 10 may be positioned on and coupled with the larger diameter tubular for interfacing engagement thereof with the smaller diameter tubular, or engagement interfaces 10 may be positioned on and coupled with the smaller diameter tubular for interfacing engagement thereof with the larger diameter tubular. In FIG. 2E, engagement interfaces 10 are positioned on and coupled with tubular 30, and engaged with opposing engagement surface of tubular 40, i.e. outer wall 46. In FIG. 2F, engagement interfaces 10 are positioned on and coupled with tubular 40, and engaged with opposing engagement surface of tubular 30, i.e. inner wall 32.

As used herein, "opposing tubular" refers to a tubular that is movably engaged with a different tubular, where the different tubular has at least one of the engagement interfaces coupled thereon to interface engagement with the opposing tubular.

Mounting of Polycrystalline Diamond Elements and Wear Characteristics

Figure 3D:
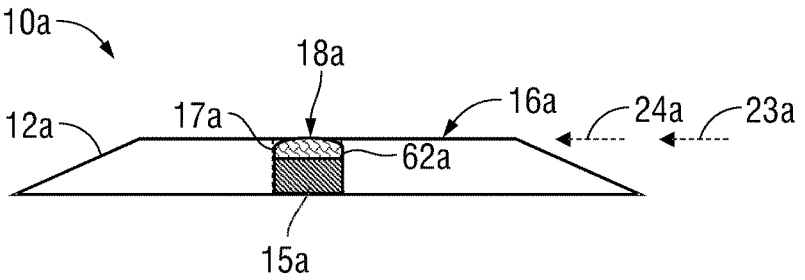
FIG. 3D is a side view of the tubular engagement interface of FIG. 3A, after the occurrence of wear.
Figure 3B:
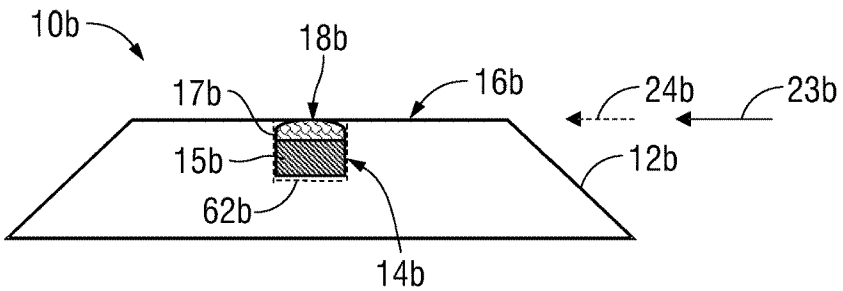
FIG. 3B is a side view of a tubular engagement interface including polycrystalline diamond elements that are flush with an engagement surface of a body of the tubular engagement interface, with the polycrystalline diamond elements positioned within a socket in the body.
Figure 3A:
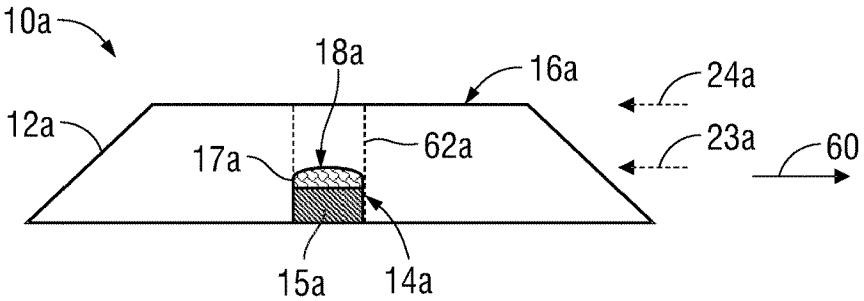
FIG. 3A is a side view of a tubular engagement interface including polycrystalline diamond elements positioned below an engagement surface of a body of the tubular engagement interface, prior to the occurrence of wear.
Figure 3C:
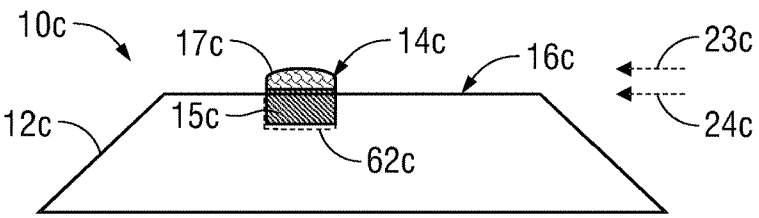
FIG. 3C is a side view of a tubular engagement interface including polycrystalline diamond elements extending above an engagement surface of a body of the tubular engagement interface, with the polycrystalline diamond elements positioned within a socket in the body.

With reference to FIGS. 3A-3D, the mounting of the polycrystalline diamond elements is shown and described. Bodies 12*a*-12*c* of engagement interfaces 10*a*-10*c*, which each may be the body of, part of, attached to, or integral with a drill pipe protector or sucker rod guide, are depicted with three differently mounted polycrystalline diamond elements 14*a*, 14*b*, and 14*c*, as shown in FIGS. 3A, 3B and 3C, respectively.

Polycrystalline diamond element 14*a* is exemplary of an underexposed polycrystalline diamond element, such that the polycrystalline diamond element is positioned below plane 24*a* defined by body engagement surface 16*a*. Thus, in operation polycrystalline diamond element 14*a* will engage with another tubular after the body engagement surface 16*a* is worn down sufficiently to expose the diamond engagement surface 18*a* of the polycrystalline diamond element 14*a*, as shown in FIG. 3D, which depicts engagement interface 10*a* after the occurrence of wear, depicted in FIG. 3D as 60. Thus, in FIG. 3A, diamond engagement surface 18*a* is positioned within plane 23*a* and body engagement surface 16*a* is positioned within 24a, which is above plane 23*a* and, in operation, in closer proximity to an opposing tubular surface. However, after a sufficient amount of wear 60, body 12*a* is worn down to a degree that plane 24*a* is coplanar with plane 23*a*; or such that plane 24*a* is below plane 23*a* and, in operation, plane 23*a* is in equal or closer proximity to an opposing tubular surface.

Polycrystalline diamond element 14*b*, as shown in FIG. 3B, is exemplary of a flush mounted polycrystalline diamond element, such that diamond engagement surface 18*b* resides in plane 24*b* defined by body engagement surface 16*b* of body 12*b*. That is, the plane defined by diamond engagement surface 18*b*, plane 23*b*, is coplanar with the plane defined by body engagement surface 16*b*, plane 24*b*. Thus, in operation, polycrystalline diamond element 14*b* will engage with an opposing tubular simultaneously with the engagement between body engagement surface 16*b* and the opposing tubular.

Polycrystalline diamond element 14*c*, as shown in FIG. 3C, is exemplary of an exposed polycrystalline diamond element, such that the polycrystalline diamond element is positioned above plane 24*c* defined by body engagement surface 16*c* of body 12*c*, and within plane 23*c*. Thus, in operation, polycrystalline diamond element 14*c* will engage with an opposing tubular prior to engagement between body engagement surface 16*c* and the opposing tubular.

Thus, in some embodiments, the polycrystalline diamond elements disclosed herein provide "back-up wear resistance capability" to the associated engagement interface. As used herein, "back-up wear resistance capability" refers to the arrangement of the polycrystalline diamond elements relative to the body such that, the diamond engagement surfaces engage with an opposing tubular only after sufficient wear of the body has occurred (e.g., as shown in FIGS. 3A and 3D).

In other embodiments, the polycrystalline diamond elements disclosed herein provide "concurrent wear resistance capability" to the associated engagement interface. As used herein, "concurrent wear resistance capability" refers to the arrangement of the polycrystalline diamond elements relative to the body such that, the diamond engagement surfaces engage with an opposing tubular upon engagement between the body and the opposing tubular, without requiring the occurrence of wear prior to engagement between the diamond engagement surfaces and the opposing tubular (e.g., as shown in FIG. 3B).

In still other embodiments, the polycrystalline diamond elements disclosed herein provide "primary wear resistance capability" to the associated engagement interface. As used herein, "primary wear resistance capability" refers to the arrangement of the polycrystalline diamond elements relative to the body such that, the diamond engagement surfaces engage with an opposing tubular prior to engagement between the body and the opposing tubular, and without requiring the occurrence of wear prior to engagement between the diamond engagement surfaces and the opposing tubular (e.g., as shown in FIG. 3C). As such, polycrystalline diamond elements 14*a*, 14*b*, and 14*c* provide primary, concurrent, and back-up wear resistance capability to protectors for drill pipe or sucker rods, respectively.

The engagement interfaces disclosed herein are not limited to including only one of exposed (FIGS. 1A and 3C), flush (FIGS. 1B and 3B, or recess (FIGS. 1C and 3A) mounted polycrystalline diamond elements, but may include any combination thereof.

As shown in FIGS. 3A-3D, polycrystalline diamond elements 14*a*-14*c* may be positioned and or coupled with or within sockets or cavities 62*a*-62*c* within bodies 12*a*-12*c*, respectively. Also, each polycrystalline diamond element 14*a*-14*c* includes support 15*a*-15*c*, respectively, and diamond layer 17*a*-17*c*, respectively. Diamond layers 17*a*-17*c* may be coupled with supports 15*a*-15*c*, and supports 15*a*-15*c* may be coupled with bodies 12*a*-12*c*, respectively. For example, diamond layers 17*a*-17*c* may be or include thermally stable polycrystalline diamond or PDC, and supports may be or include tungsten carbide.

Having described engagement interfaces, generally, certain embodiments and applications thereof will now be described in further detail.

Sucker Rod with Guide

In some embodiments, the engagement interfaces disclosed herein are provided on a sucker rod guide, such as for interfacing the engagement between a sucker rod string movably positioned within production tubing. For example, with reference to FIG. 2F, tubular 40 may be a sucker rod with engagement interfaces 10 forming at least a portion of a sucker rod guide thereon, and tubular 30 may be a production tubing within which the sucker rod is positioned. As would be understood by one skilled in the art, a sucker rod is a rod (e.g., a steel rod) that is used to make up the mechanical assembly between the surface and downhole components of a rod pumping system. Sucker rods may be from 25 to 30 feet in length, and may be threaded at each end to enable the downhole components to be run and retrieved easily.

With reference to FIGS. 4A-4D, one exemplary sucker rod assembly 101*a*, including sucker rod 102 with sucker rod guide 104. Sucker rod 102 is engaged with sucker rod guide 104. In some embodiments, at least some portions of sucker rod guide 104 are molded directly onto sucker rod 102. For example, body 12 of sucker rod guide 104 may be or include a moldable material (e.g., a polymer), such as molded rubber, nylon, polyurethane, synthetic polyamide, polyether ether ketone (PEEK), or another plastic or elastomer. Such materials may be molded onto sucker rod 102 via any of various polymer molding techniques, such as extrusion molding. Sucker rod 102 may be or include a metal rod, such as a steel rod. Thus, in some embodiments, sucker rod guide 104 is coupled with sucker rod 102. In some such embodiments, sucker rod guide 104 is static, relative to sucker rod 102.

Body 12 of sucker rod guide 104 includes base 13 circumferentially surrounding sucker rod 102. Body 12 also includes protrusions 110 extending outward from base 13, away from sucker rod 102. In some embodiments, protrusions 110 are in the form of peaks, blades, ribs, fins, or vanes extending outward from sucker rod 102. Protrusions 110 are spaced radially about base 13 and sucker rod 102, such that cavities or valleys 111 are positioned between adjacent protrusions 110. Each protrusion 110 defines a body engagement surface 16 for engagement with, for example, production tubing to protect and/or guide sucker rod 102 during operation thereof.

Figure 4A:
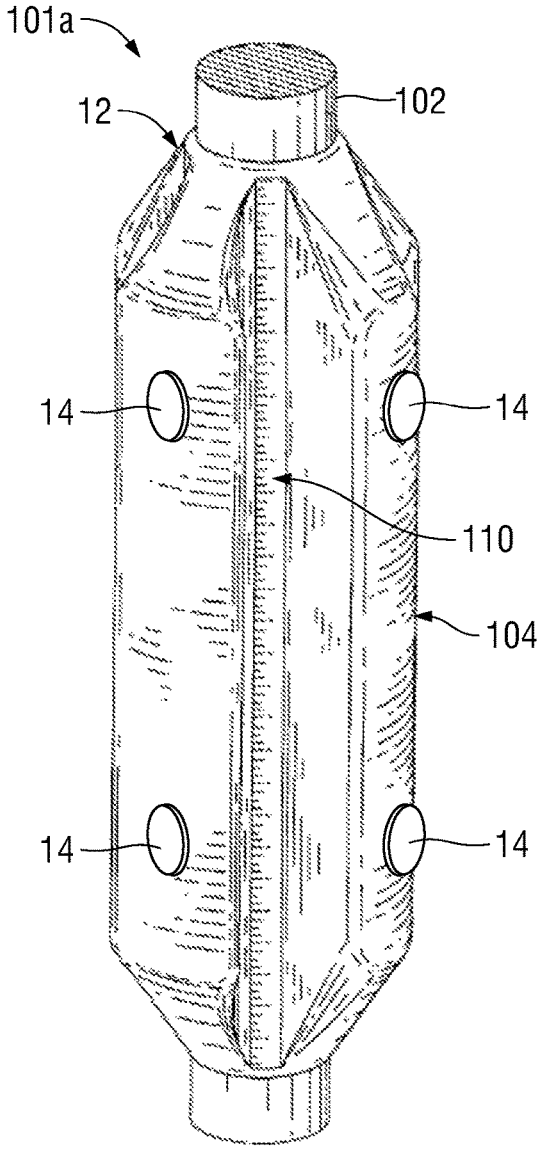
FIG. 4A is a perspective view of a sucker rod and sucker rod guide with polycrystalline diamond elements thereon.
Figure 4B:
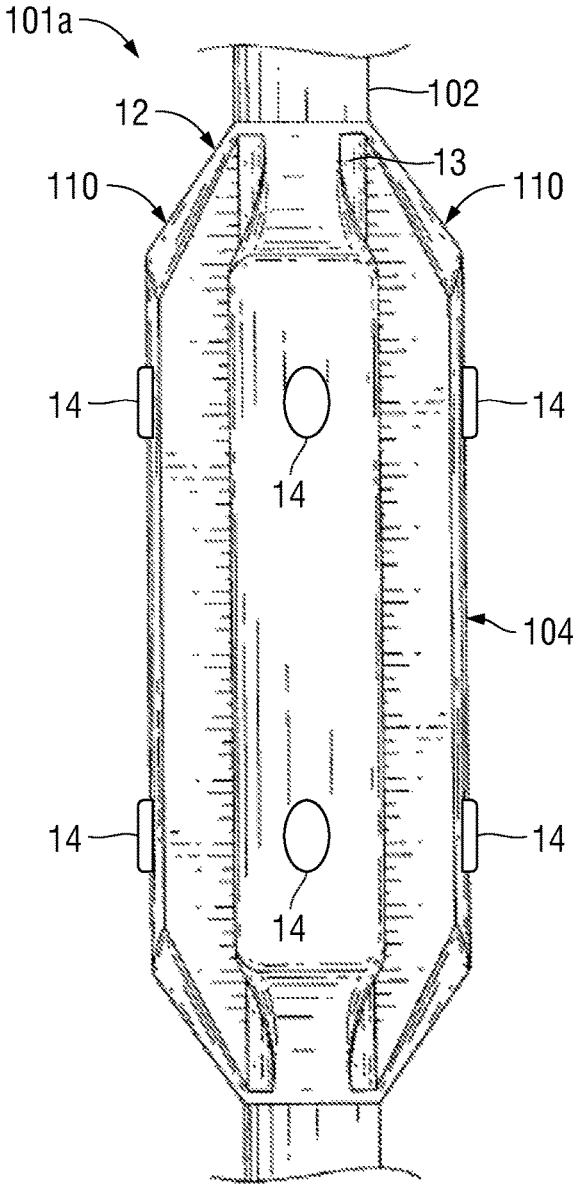
FIG. 4B is a side view of the sucker rod and sucker rod guide of FIG. 4A.
Figure 4C:
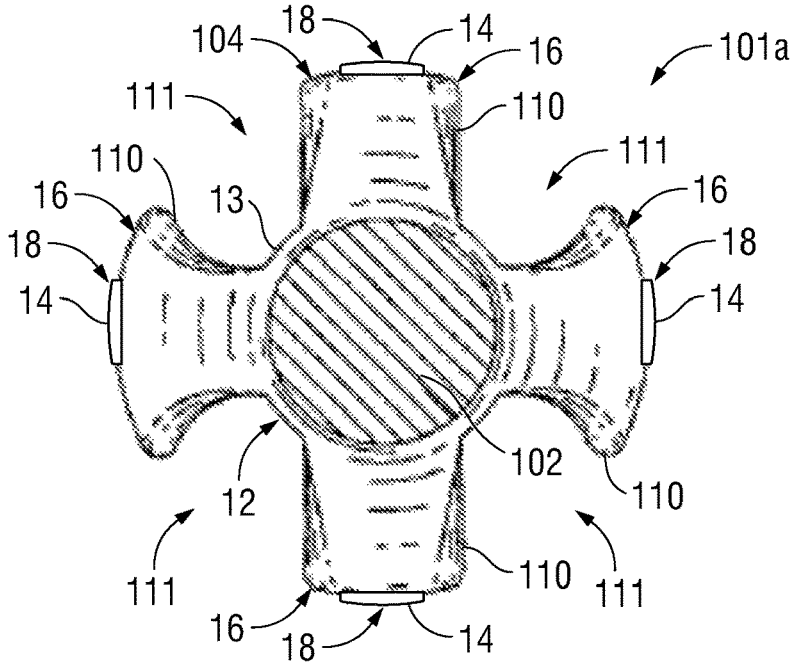
FIG. 4C is a top view of the sucker rod and sucker rod guide of FIG. 4A.

At least one polycrystalline diamond element is coupled with the sucker rod guides disclosed herein. As shown in FIG. 4A, sucker rod guide 104 includes four protrusions 110, each with two polycrystalline diamond elements 14 thereon. However, the sucker rod guides disclosed herein are not limited to having this number of protrusions or polycrystalline diamond elements, and may include any number of polycrystalline diamond elements arranged in any of various arrangements.

Each polycrystalline diamond element 14 may be embedded within body engagement surface 16 or otherwise attached to sucker rod guide 104, such that polycrystalline diamond elements 14 are positioned to protect and guide the engagement between sucker rod 102 and, for example, production tubing. As shown, polycrystalline diamond elements 14 have convex engagement surfaces 18 for engagement with production tubing and are in the form of inserts that are inserted into sucker rod guide 104. However, the polycrystalline diamond elements disclosed herein are not limited to this particular arrangement, shape, or number.

Figure 4D:
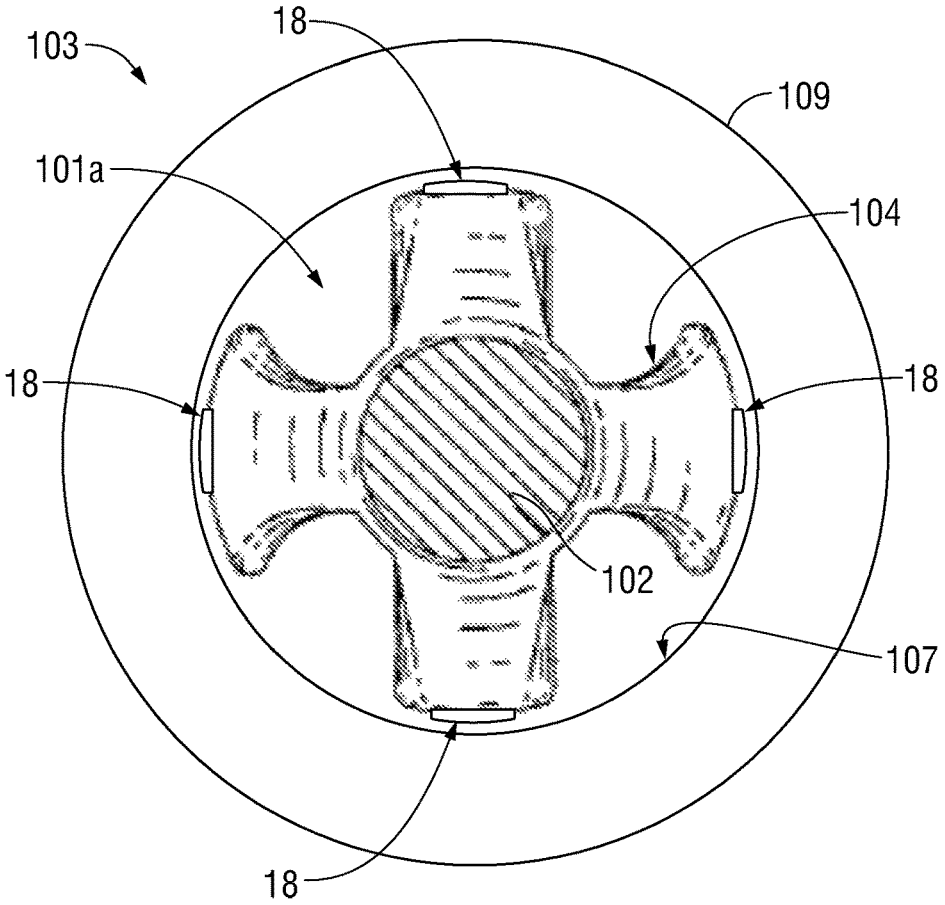
FIG. 4D is a top view of the sucker rod and sucker rod guide of FIG. 4A positioned within production tubing.

FIG. 4D depicts tubular assembly 103, including sucker rod 102 and sucker rod guide 104, engaged within production tubing 109. As shown, diamond engagement surfaces 18 interface engagement between sucker rod 102 and inner surface 107 of production tubing 109.

Figure 5:
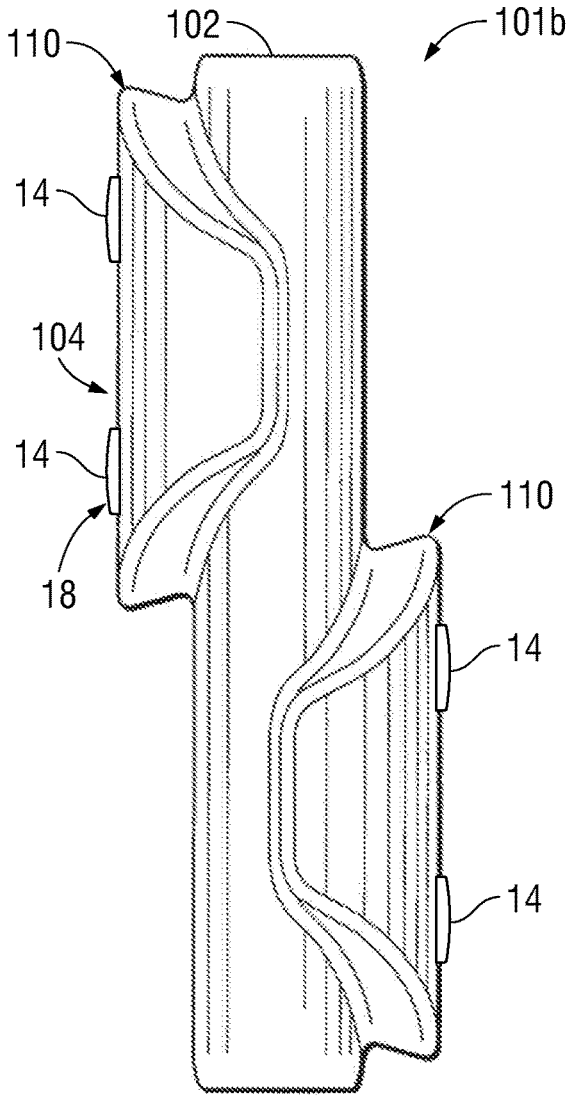
FIG. 5 is a side view of another sucker rod guide with polycrystalline diamond elements thereon.

FIG. 5 depicts another embodiment of a sucker rod assembly 101*b*, including sucker rod 102 and sucker rod guide 104, with like reference numerals indicating like elements. Sucker rod 102 is engaged with sucker rod guide 104, which includes protrusions 110, each having convex polycrystalline diamond elements 14 inserted therein. The difference between FIGS. 4A-4D and FIG. 5 is in the form, shape, arrangement, and positioning of sucker rod guide 104. Thus, in FIGS. 4A-4D and 5, the tubular engagement interface disclosed herein, including body 12 and polycrystalline diamond elements 14, are in the form of, or form a portion of, a sucker rod guide.

U.S. Pat. No. 6,152,223 provides some relevant disclosure with respect to sucker rod guides, and is hereby incorporated herein. In some embodiments, the sucker rod guide disclosed herein (e.g., the sucker rod guide of FIGS. 4A-4D) is a sucker rod guide the same or similar as described in FIGS. 1-6 of U.S. Pat. No. 6,152,223, with the addition of the polycrystalline diamond elements described herein.

Drill Pipe

In some embodiments, the engagement interfaces disclosed herein are provided on a pipe protector of a pipe (e.g., a drill pipe), such as for interfacing the engagement between a drill pipe and casing during drilling operations where the drill pipe is movably positioned within the casing. For example, with reference to FIG. 2F, tubular 40 may be a drill pipe with engagement interfaces 10 forming at least a portion of a pipe protector thereon, and tubular 30 may be casing within which the drill pipe is positioned.

Figure 6:
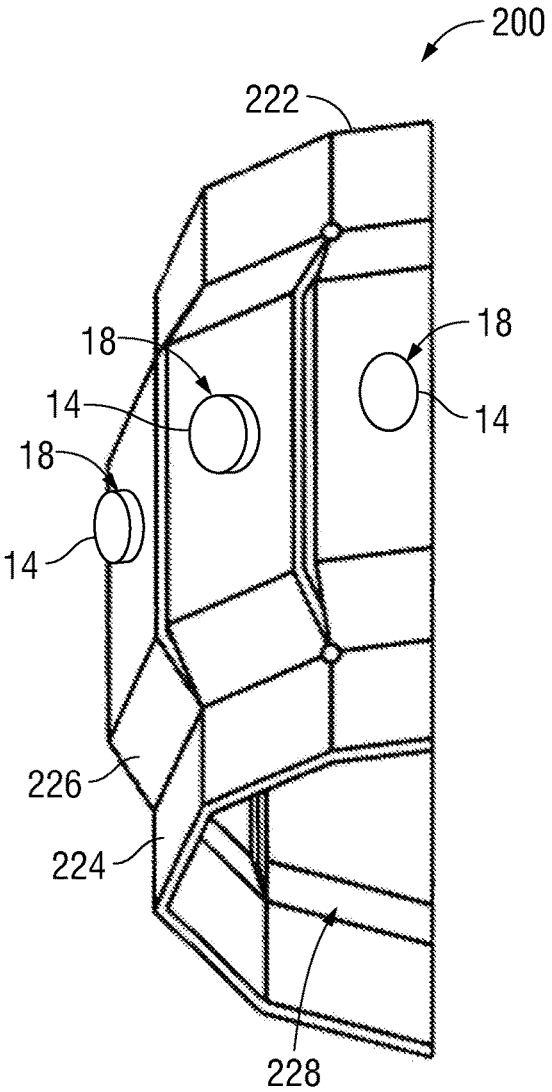
FIG. 6 is a partial, perspective view of a drill pipe protector frame having polycrystalline diamond elements thereon.
Figure 8:
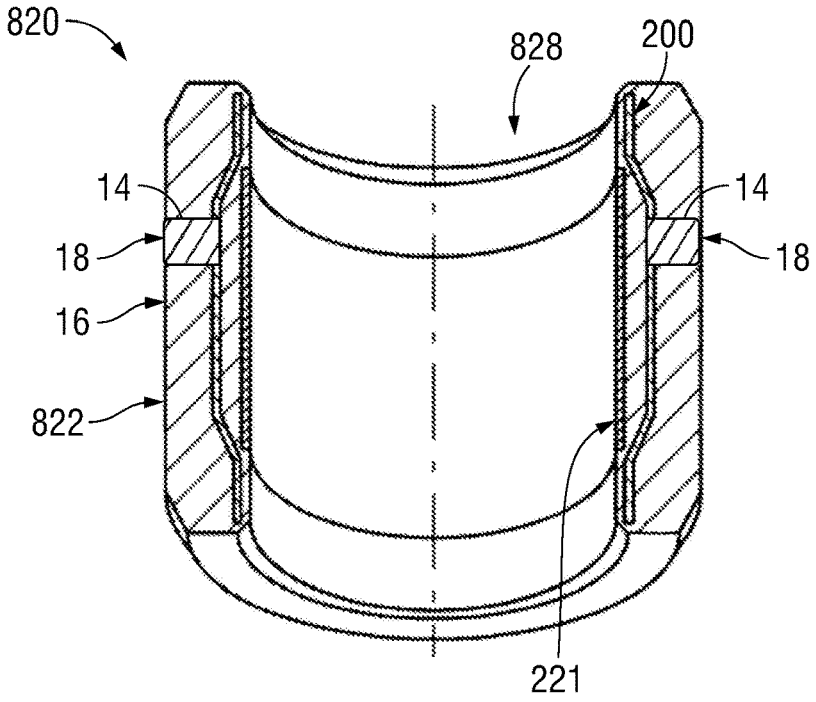
FIG. 8 is a cross-sectional view of a drill pipe protector having polycrystalline diamond elements thereon.

With reference to FIGS. 6 and 8, one drill pipe protector in accordance with the present disclosure will be described. U.S. Pat. No. 5,833,019 provides certain relevant disclosure related to pipe protectors, and is incorporated herein by reference. In some embodiments, the drill pipe protector disclosed is in accordance with the pipe protector shown and described in U.S. Pat. No. 5,833,019, such as in FIGS. 1, 2 and 4 of U.S. Pat. No. 5,833,019, with the addition of the polycrystalline diamond elements disclosed herein incorporated into the pipe protector.

Drill pipe protector 820 includes body 822, also referred to as a sleeve, which defines a portion of the wear surface or body engagement surface 16. Embedded within body 822 is frame 200, forming cage 222, as shown in FIG. 6. Also, inner frame 221 may be embedded within body 822. Polycrystalline diamond elements 14 may be coupled with frame 222, such that polycrystalline diamond elements 14 are also embedded at least partially within body 822. Polycrystalline diamond elements 14 may be embedded within body such that engagement surface 18 is flush with body engagement surface 16, is recessed relative to body engagement surface 16, or extends above body engagement surface 16.

With reference to FIG. 6, frame 200 includes frame body 224 and protrusions 226. Protrusions 226 extend outward from frame body 224. Attached to, embedded within, inserted within, or otherwise coupled with protrusions 226 are polycrystalline diamond elements 14, which are positioned to engage with, for example, casing during drilling operations. Frame 200 includes cavity 228, which is at least partially defined by frame body 224. With reference to FIG. 8, a cross-sectional view of drill pipe protector 820, frame 200 is embedded within body 822. Polycrystalline diamond elements 14 are positioned to engage with, for example, casing during drilling operations. Drill pipe may be positioned within opening 828, such that body 822 and drill pipe protector frame 200 are positioned about drill pipe, and between drill pipe and casing. For example, drill pipe protector 820 may be arranged about a drill pipe in the same or substantially the same way as drill pipe protector 722, as shown in FIGS. 7A-7C.

Figure 7A:
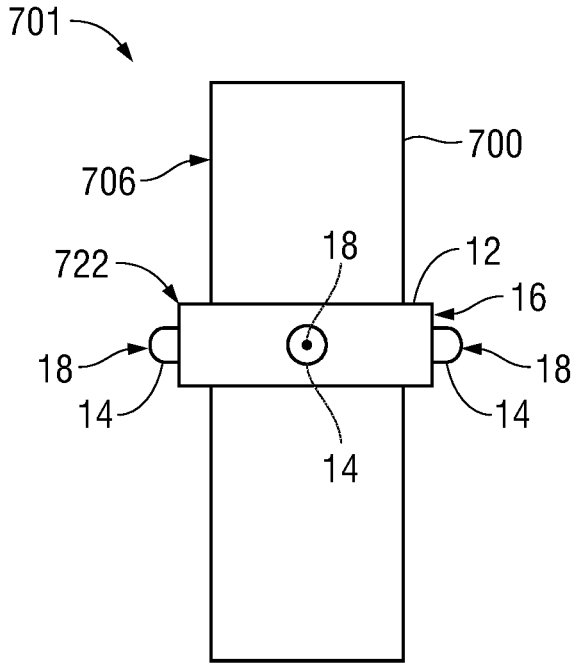
FIG. 7A is a side view of a pipe protector, including polycrystalline diamond elements thereon, on a drill pipe.
Figure 7B:
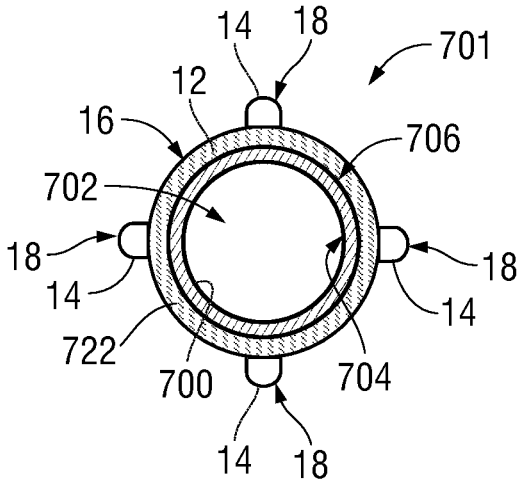
FIG. 7B is an end view of the pipe protector and drill pipe of FIG. 7A.
Figure 7C:
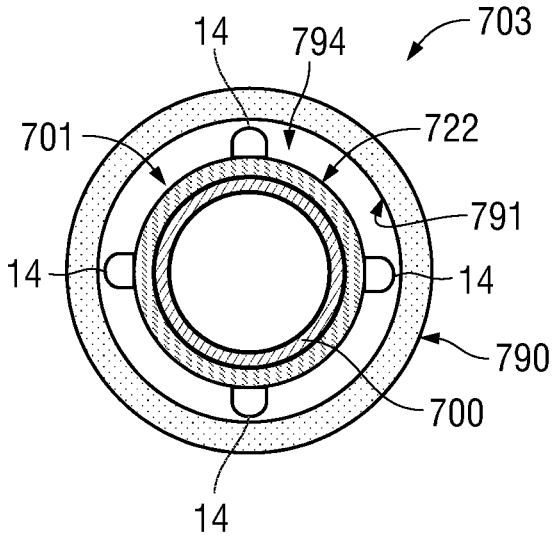
FIG. 7C is an end view of the pipe protector and drill pipe of FIG. 7A, positioned within a wellbore casing.

FIG. 7A depicts a side view of tubular assembly 701, including drill pipe 700 with drill pipe protector 722 coupled thereabout, including polycrystalline diamond elements 14. FIG. 7B depicts a top view of drill pipe 700 and drill pipe protector 722, showing cavity 702 of drill pipe 700 defined by inner surface 704 of drill pipe 700, and drill pipe protector 722 coupled about outer surface 706 of drill pipe 700. FIG. 7C depicts a top view of assembly 703, including tubular assembly 701 positioned within casing 790. As shown, drill pipe 700 and drill pipe protector 722 are positioned within cavity 794 of casing 790. Polycrystalline diamond elements 14 interface any engagement that may occur between drill pipe 700 and inner wall 791 of casing 790 during operation.

Figure 9:
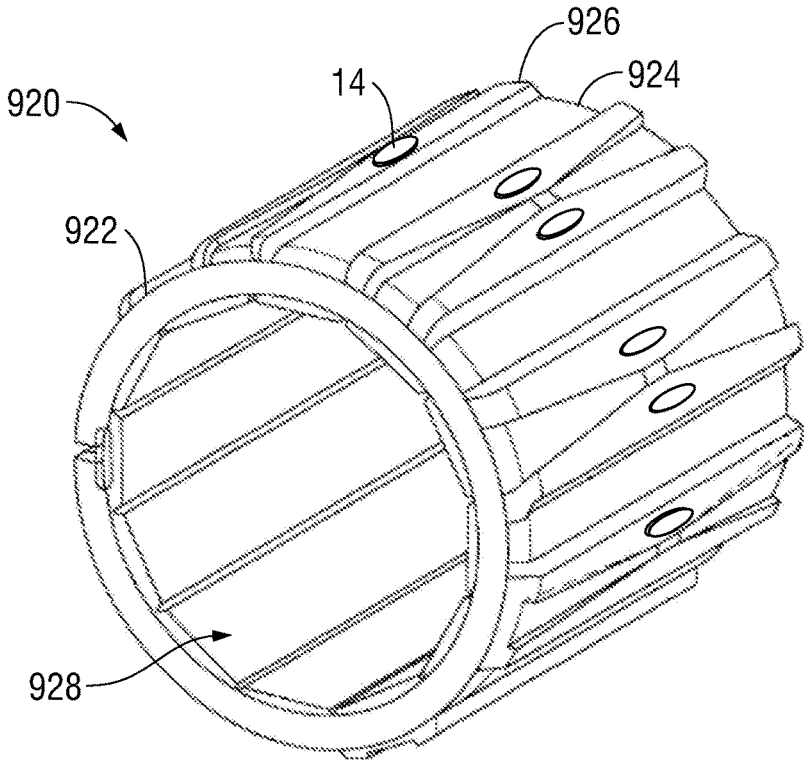
FIG. 9 is another perspective view of a drill pipe protector having polycrystalline diamond elements thereon.

With reference to FIG. 9, drill pipe protector 920 is depicted, including drill pipe protector body 922, which may be formed of any material, such as molded rubber, nylon, plastic, polymer, polyurethane, synthetic polyamide, or polyether ether ketone (PEEK). Drill pipe protector body 922 includes base 924 and protrusions 926, which extend outward from base 924. Attached to, embedded within, or inserted within protrusions 926 are polycrystalline diamond elements 14 positioned to engage with, for example, casing during drilling operations. Drill pipe may be positioned within opening 928, such that drill pipe protector body 922 is positioned about drill pipe, and between drill pipe and casing.

Drill pipe protector 920 in FIG. 9 is a wedgelift drill pipe-protector. As would be understood by one skilled in the art, drill pipe protector 920 may be coupled to drill pipe via latch pins, such that the drill pipe is positioned within opening 928. Drill pipe protector 920 is slidingly engageable with drill pipe, such that drill pipe protector 920 is movable axially along the length of the drill pipe during operation of the drill pipe. During drilling, the drill pipe rotates within and relative to drill pipe protector 920. Protrusions 926 of drill pipe protector 920 extend outward, away from the drill pipe, by a distance that is sufficient to prevent the drill bit, bottom hole assembly, and other components of the drill string from engaging with the casing. That is, protrusions 926 extend outward, away from the drill pipe, such that protrusions 926 and/or polycrystalline diamond elements 14 thereon engage with the casing while keeping the drill bit, bottom hole assembly, and other components of the drill string spaced apart from the casing. For example, wherein the drill pipe couples with a downhole tool, such as a drill bit, the drill pipe typically includes threading therein to couple with the tool. The portion of the drill pipe that includes the threading is typically thicker than other portions of the drill pipe to compensate for the loss of metal due to the presence of threading. At this thicker part of the drill pipe, referred to as the "upset", the drill pipe has a larger outer diameter as a result of the additional thickness. The protrusions 926, in such an embodiment, extend outward and away from the drill pipe by a distance that is sufficient to prevent the upset of the drill pipe from engaging with the casing. Thus, in operation the drill pipe protectors disclosed herein contact the internal diameter of a well (e.g., the casing) when the drill pipe deflects off center in the casing or wellbore to protect the casing or wellbore from contact with the drill pipe or portions thereof during rotation of the drill pipe. U.S. Pat. No. 6,378,633 provides some relevant background discussion related to drill pipe protectors, and is hereby incorporated herein by reference. In some embodiments, the drill pipe protector disclosed herein is a pipe protector in accordance with FIG. 7 of U.S. Pat. No. 6,378,633, with the addition of the polycrystalline diamond elements disclosed herein.

Polycrystalline Diamond

The technology of the present application preferably employs convex polycrystalline diamond elements, preferably polished polycrystalline diamond compact (PDC) elements, to provide primary, concurrent, or back-up wear resistance capability to protectors for drill pipe or sucker rods. However, the polycrystalline diamond elements of the present technology may alternatively be planar with radiused or highly radiused edges. The polycrystalline diamond elements of the current application may be, for example, thermally stable polycrystalline diamond or PDC. In some embodiments, the polycrystalline diamond elements are backed (e.g., supported) or unbacked (e.g., unsupported), such as by tungsten carbide. As would be understood by one skilled in the art, the polycrystalline diamond elements disclosed herein may be non-leached, leached, leached and backfilled, or coated (e.g., via CVD) all by methods known in the art.

In some embodiments, the polycrystalline diamond elements disclosed herein may have diameters as small as 3 mm (about ⅛") or as large as 75 mm (about 3"), for example, depending on the application and the configuration and diameter of the engaged surface. Some of the polycrystalline diamond elements disclosed herein will have diameters of from 8 mm (about 5/16") to 25 mm (about 1"). One skilled in the art would understand that the polycrystalline diamond elements are not limited to these particular dimensions and may vary in size and shape depending on the particular application.

In certain applications, the polycrystalline diamond elements disclosed herein have increased cobalt content transitions layers between the outer polycrystalline diamond surface and a supporting tungsten carbide slug. In some applications, the polycrystalline diamond elements disclosed herein may be unsupported by tungsten carbide and may be substantially "standalone", discrete polycrystalline diamond bodies that are directly mounted (e.g., onto tubular member). In embodiments where the polycrystalline diamond elements are planar face or domed polycrystalline diamond elements, the polycrystalline diamond elements may be mounted in a manner to allow the polycrystalline diamond elements to rotate about its own axis. Reference is made to U.S. Pat. No. 8,881,849, to Shen et. al., as a non-limiting example of methods to provide for a polycrystalline diamond element that spins about its own axis while in facial contact with a diamond reactive material.

Although the polycrystalline diamond elements are most commonly available in cylindrical shapes, it is understood that the technology of the application may be practiced with polycrystalline diamond elements that are square, rectangular, oval, any of the shapes described herein with reference to the Figures, or any other appropriate shape known in the art.

In some embodiments, the polycrystalline diamond elements are subjected to edge radius treatment. In some embodiments of the technology of this application that employ planar or concave polycrystalline diamond elements, it is preferred to employ edge radius treatment of such polycrystalline diamond elements. One purpose of employing an edge radius treatment is to reduce or avoid potential for outer edge cutting or scribing at the outer limits of the linear engagement area of a given polycrystalline diamond element with the opposing tubular (e.g., a curved surface).

The polycrystalline diamond elements of the present application may be deployed in a manner that preferably precludes any edge or sharp contact between the polycrystalline diamond elements and ferrous materials with which they are slidingly engaged (e.g., ferrous casing or production tubing). The preclusion of edge contact can overcome the potential for machining of the ferrous material and chemical interaction between the diamond and ferrous material.

Mounting of Polycrystalline Diamond

In some embodiments, the polycrystalline diamond elements of the present application may be mounted on a metal frame and over-molded by a thermoplastic material, or other common materials used for protectors.

The polycrystalline elements of the present application may be underexposed, flush mounted, or exposed relative to the protector or guide body. In certain embodiments, the polycrystalline diamond elements of the present application may be molded directly into protector materials and retained therein. Such molding may occur directly onto the parent tubular or may occur separate from the parent tubular and then the molded parts may be attached in a separate step. Alternatively, sockets may be molded into the thermoplastic or alternative body material and the polycrystalline diamond elements may then be mounted afterwards using gluing, or threading or other methods as known in the art. In some embodiments, the polycrystalline diamond elements may be mounted on couplings of a sucker rod assembly.

In yet another alternative the polycrystalline diamond elements of the current application may be attached to a metal frame that is not over molded but, rather, acts as the primary frame with the polycrystalline diamond elements providing substantially all of the wear resistance and standoff distance of the protector.

In another alternative embodiment, the polycrystalline diamond elements of the current technology may be mounted in subassemblies that allow for the polycrystalline diamond elements to rotate about their own axis, as is known in the art.

The polycrystalline diamond elements of the current technology may be recovered from used protectors or guides and reused in freshly molded or deployed protectors or guides. The ability to recover and reuse the polycrystalline diamond elements reduces the ultimate cost of the use of the technology.

Lapping or Polishing

In certain applications, the polycrystalline diamond element, or at least the engagement surface thereof, is lapped or polished, optionally highly lapped or highly polished. As used herein, a surface is defined as "highly lapped" if the surface has a surface finish of 20 μin or about 20 μin, such as a surface finish ranging from about 18 to about 22 μin. As used herein, a surface is defined as "polished" if the surface has a surface finish of less than about 10 μin, or of from about 2 to about 10 μin. As used herein, a surface is defined as "highly polished" if the surface has a surface finish of less than about 2 μin, or from about 0.5 μin to less than about 2 μin. In some embodiments, the engagement surface has a surface finish ranging from 0.5 μin to 40 μin, or from 2 μin to 30 μin, or from 5 μin to 20 μin, or from 8 μin to 15 μin, or less than 20 μin, or less than 10 μin, or less than 2 μin, or any range therebetween. Polycrystalline diamond that has been polished to a surface finish of 0.5 μin has a coefficient of friction that is about half of standard lapped polycrystalline diamond with a surface finish of 20-40 μin. U.S. Pat. Nos. 5,447,208 and 5,653,300 to Lund et al., the entireties of which are incorporated herein by reference, provide disclosure relevant to polishing of polycrystalline diamond. As would be understood by one skilled in the art, surface finish may be measured with a profilometer or with Atomic Force Microscopy.

Diamond Reactive Material

In some embodiments, the opposing tubular, or at least the surface thereof, is or includes a diamond reactive material. As used herein, a "diamond reactive material" is a material that contains more than trace amounts of diamond catalyst or diamond solvent. As used herein, a diamond reactive material that contains more than "trace amounts" of diamond catalyst or diamond solvent contains at least 2 percent by weight (wt. %) diamond catalyst or diamond solvent. In some embodiments, the diamond reactive materials disclosed herein contain from 2 to 100 wt. %, or from 5 to 95 wt. %, or from 10 to 90 wt. %, or from 15 to 85 wt. %, or from 20 to 80 wt. %, or from 25 to 75 wt. %, or from 25 to 70 wt. %, or from 30 to 65 wt. %, or from 35 to 60 wt. %, or from 40 to 55 wt. %, or from 45 to 50 wt. % of diamond catalyst or diamond solvent. As used herein, a "diamond catalyst" is a chemical element, compound, or material capable of catalyzing graphitization of polycrystalline diamond, such as under load and at a temperature at or exceeding the graphitization temperature of diamond (i.e., about 700° C.). As used herein, a "diamond solvent" is a chemical element, compound, or material capable of solubilizing polycrystalline diamond, such as under load and at a temperature at or exceeding the graphitization temperature of diamond. Thus, diamond reactive materials include materials that, under load and at a temperature at or exceeding the graphitization temperature of diamond, can lead to wear, sometimes rapid wear, and failure of components formed of polycrystalline diamond, such as diamond tipped tools. Diamond reactive materials include, but are not limited to, metals, metal alloys, and composite materials that contain more than trace amounts of diamond catalyst or solvent elements. In some embodiments, the diamond reactive materials are in the form of hard facings, coatings, or platings. For example, and without limitation, the diamond reactive material may be ferrous, cobalt, nickel, ruthenium, rhodium, palladium, chromium, manganese, copper, titanium, tantalum, or alloys thereof. In some embodiments, the diamond reactive material is a steel or cast iron. In some embodiments, the diamond reactive material is a superalloy including, but not limited to, iron-based, cobalt-based and nickel-based superalloys. In certain embodiments, the opposing tubular, or at least the surface thereof, is not and/or does not include (i.e., specifically excludes) so called "superhard materials." As would be understood by one skilled in the art, "superhard materials" are a category of materials defined by the hardness of the material, which may be determined in accordance with the Brinell, Rockwell, Knoop and/or Vickers scales. For example, superhard materials include materials with a hardness value exceeding 40 gigapascals (GPa) when measured by the Vickers hardness test. As used herein, superhard materials include materials that are at least as hard as tungsten carbide tiles and/or cemented tungsten carbide, such as is determined in accordance with one of these hardness scales, such as the Brinell scale. One skilled in the art would understand that a Brinell scale test may be performed, for example, in accordance with ASTM E10-14; the Vickers hardness test may be performed, for example, in accordance with ASTM E384; the Rockwell hardness test may be performed, for example, in accordance with ASTM E18; and the Knoop hardness test may be performed, for example, in accordance with ASTM E384. The "superhard materials" disclosed herein include, but are not limited to, tungsten carbide (e.g., tile or cemented), infiltrated tungsten carbide matrix, silicon carbide, silicon nitride, cubic boron nitride, and polycrystalline diamond. Thus, in some embodiments, the opposing tubular is partially or entirely composed of material(s) (e.g., metal, metal alloy, composite) that is softer (less hard) than superhard materials, such as less hard than tungsten carbide (e.g., tile or cemented), as determined in accordance with one of these hardness tests, such as the Brinell scale. As would be understood by one skilled in the art, hardness may be determined using the Brinell scale, such as in accordance with ASTM E10-14. As would be understood by one skilled in the art, a "superalloy" is a high-strength alloy that can withstand high temperatures.

From the descriptions and figures provided above it can readily be understood that the technology of the present application may be employed in a broad spectrum of applications, including those in downhole environments. The technology provided herein additionally has broad application to other industrial applications. One skilled in the art would understand that the present disclosure is not limited to use with drill pipes and sucker rods or even to use in downhole applications, and that the concepts disclosed herein may be applied to the engagement between any surfaces.

Embodiments

Certain embodiments will now be set forth.

Embodiment 1. A tubular assembly, the assembly include: a first tubular including an outer wall, an inner wall, and a hollow that is at least partially defined by the inner wall; a second tubular including an outer wall, wherein the second tubular is movably engaged with the first tubular, such that the second tubular is at least partially positioned within the hollow of the first tubular; a tubular engagement interface including a body, the body including a body engagement surface, and a polycrystalline diamond element coupled with the body, the polycrystalline diamond element including a diamond engagement surface; wherein the tubular engagement interface is coupled with one of the first or second tubulars, such that the diamond engagement surface engages with an opposing engagement surface of the other of the first or second tubulars when the first and second tubulars are movably engaged.

Embodiment 2. The assembly of embodiment 1, wherein the tubular engagement interface is coupled with the inner wall of the first tubular such that the body engagement surface, the diamond engagement surface, or combinations thereof are engaged with the opposing engagement surface of the outer wall of the second tubular.

Embodiment 3. The assembly of embodiment 1, wherein the tubular engagement interface is coupled with the outer wall of the second tubular such that the body engagement surface, the diamond engagement surface, or combinations thereof are engaged with the opposing engagement surface of the inner wall of the first tubular.

Embodiment 4. The assembly of any of embodiments 1 to 3, wherein the second tubular is slidingly engaged within the first tubular.

Embodiment 5. The assembly of any of embodiments 1 to 4, wherein the second tubular is rotatably engaged within the first tubular.

Embodiment 6. The assembly of any of embodiments 1 to 5, wherein the polycrystalline diamond element is positioned on the body such with at least a portion of the diamond engagement surface is positioned above the body engagement surface, such that the diamond engagement surface is engaged with the opposing engagement surface.

Embodiment 7. The assembly of any of embodiments 1 to 5, wherein the polycrystalline diamond element is positioned on the body such with at least a portion of the diamond engagement surface is flush with the body engagement surface, such that the diamond engagement surface and the body engagement surface are engaged with the opposing engagement surface.

Embodiment 8. The assembly of any of embodiments 1 to 5, wherein the polycrystalline diamond element is positioned on the body such with the diamond engagement surface is positioned below the body engagement surface, such that the body engagement surface is engaged with the opposing engagement surface.

Embodiment 9. The assembly of embodiment 3, wherein the first tubular includes wellbore casing, wherein the second tubular includes drill pipe, and wherein the tubular engagement interface includes a drill pipe protector coupled with the drill pipe.

Embodiment 10. The assembly of embodiment 9, wherein the body at least partially forms a frame of the drill pipe protector, the frame defining a hollow, wherein the second tubular is positioned within the hollow of the body such that the drill pipe protector at least partially surrounds at least a portion of the second tubular, and wherein the polycrystalline diamond element is coupled with the frame and is positioned to engage with the wellbore casing.

Embodiment 11. The assembly of embodiment 3, wherein the first tubular includes production tubing in a wellbore, wherein the second tubular includes a sucker rod, and wherein the tubular engagement interface includes a sucker rod guide coupled with the sucker rod.

Embodiment 12. The assembly of embodiment 11, wherein the body of the tubular engagement interface is molded onto the sucker rod.

Embodiment 13. The assembly of any of embodiments 1 to 12, wherein the second tubular is a solid tubular.

Embodiment 14. The assembly of any of embodiments 1 to 12, wherein the second tubular is a hollow tubular.

Embodiment 15. The assembly of any of embodiments 1 to 14, wherein the opposing engagement surface includes a diamond reactive material.

Embodiment 16. The assembly of any of embodiments 1 to 15, wherein the opposing engagement surface includes steel.

Embodiment 17. The assembly of any of embodiments 16, wherein the body includes a socket, and wherein the polycrystalline diamond element is positioned within the socket.

Embodiment 18. The assembly of any of embodiments 1 to 17, wherein the polycrystalline diamond element is embedded within the body.

Embodiment 19. The assembly of any of embodiments 1 to 18, wherein the polycrystalline diamond element attached to the body.

Embodiment 20. The assembly of any of embodiments 1 to 19, wherein the body includes a polymer that is molded over at least a portion of the polycrystalline diamond element.

Embodiment 21. The assembly of any of embodiments 1 to 20, wherein the body includes a metal.

Embodiment 22. The assembly of embodiment 21, wherein the body includes steel.

Embodiment 23. The assembly of any of embodiments 1 to 22, wherein the body includes a polymer.

Embodiment 24. The assembly of embodiment 23, wherein the body includes a plastic or an elastomer.

Embodiment 25. The assembly of embodiment 24, wherein the body includes nylon, polyurethane, polyamide, or polyether ether ketone (PEEK).

Embodiment 26. The assembly of any of embodiments 1 to 25, wherein the diamond engagement surface is planar with radiused edges.

Embodiment 27. The assembly of any of embodiments 1 to 25, wherein the diamond engagement surface is convex.

Embodiment 28. The assembly of any of embodiments 1 to 25, wherein the diamond engagement surface is concave.

Embodiment 29. The assembly of any of embodiments 1 to 28, wherein the polycrystalline diamond element includes thermally stable polycrystalline diamond.

Embodiment 30. The assembly of any of embodiments 1 to 28, wherein the polycrystalline diamond element includes polycrystalline diamond compact.

Embodiment 31. The assembly of any of embodiments 1 to 30, wherein the diamond engagement surface is lapped, polished, highly lapped or highly polished.

Embodiment 32. The assembly of any of embodiments 1 to 31, wherein the diamond engagement surface has a surface finish of at most 20 μin.

Embodiment 33. A tubular configured for movable engagement with another tubular, the tubular including: a tubular body; a tubular wall; and a tubular engagement interface coupled with the tubular wall and extending from the tubular wall, the tubular engagement interface including a body, the body including a body engagement surface, and a polycrystalline diamond element coupled with the body, the polycrystalline diamond element including a diamond engagement surface.

Embodiment 34. The tubular of embodiment 33, wherein the tubular is a hollow tubular including an inner tubular wall and an outer tubular wall, the inner tubular wall at least partially defining a hollow of the tubular, and wherein the tubular engagement interface is coupled with the inner tubular wall.

Embodiment 35. The tubular of embodiment 33, wherein the tubular wall is an outer tubular wall, and wherein the tubular engagement interface is coupled with the outer tubular wall.

Embodiment 36. The tubular of embodiment 35, wherein the tubular is a hollow tubular including an inner tubular wall that at least partially defines a hollow of the tubular.

Embodiment 37. The tubular of embodiment 35, wherein the tubular is a solid tubular.

Embodiment 38. The tubular of any of embodiments 33 to 37, wherein the polycrystalline diamond element is positioned on the body such that at least a portion of the diamond engagement surface is positioned above the body engagement surface.

Embodiment 39. The tubular of any of embodiments 33 to 37, wherein the polycrystalline diamond element is positioned on the body such that at least a portion of the diamond engagement surface is flush with the body engagement surface.

Embodiment 40. The tubular of any of embodiments 33 to 37, wherein the polycrystalline diamond element is positioned on the body such that an entirety of the diamond engagement surface is positioned below the body engagement surface.

Embodiment 41. The tubular of any of embodiments 33 to 40, wherein the tubular includes drill pipe, and wherein the tubular engagement interface includes a drill pipe protector coupled with the drill pipe.

Embodiment 42. The tubular of embodiment 41, wherein the body at least partially forms a frame of the drill pipe protector, the frame defining a hollow, wherein the tubular is positioned within the hollow of the body such that the drill pipe protector at least partially surrounds at least a portion of the tubular, and wherein the polycrystalline diamond element is coupled with the frame.

Embodiment 43. The tubular of any of embodiments 33 to 40, wherein the tubular includes a sucker rod, and wherein the tubular engagement interface includes a sucker rod guide coupled with the sucker rod.

Embodiment 44. The tubular of embodiment 43, wherein the body of the tubular engagement interface is molded onto the sucker rod.

Embodiment 45. The tubular of any of embodiments 33 to 44, wherein the body includes a socket, and wherein the polycrystalline diamond element is positioned within the socket.

Embodiment 46. The tubular of any of embodiments 33 to 45, wherein the polycrystalline diamond element is embedded within the body.

Embodiment 47. The tubular of any of embodiments 33 to 46, wherein the polycrystalline diamond element attached to the body.

Embodiment 48. The tubular of any of embodiments 33 to 47, wherein the body includes a polymer that is molded over at least a portion of the polycrystalline diamond element.

Embodiment 49. The tubular of any of embodiments 33 to 48 wherein the body includes a metal.

Embodiment 50. The tubular of embodiment 49, wherein the body includes steel.

Embodiment 51. The tubular of embodiment 33, wherein the body includes a polymer.

Embodiment 52. The tubular of embodiment 51, wherein the body includes a plastic or an elastomer.

Embodiment 53. The tubular of embodiment 52, wherein the body includes nylon, polyurethane, polyamide, or polyether ether ketone (PEEK).

Embodiment 54. The tubular of any of embodiments 33 to 53, wherein the diamond engagement surface is planar with radiused edges.

Embodiment 55. The tubular of any of embodiments 33 to 53, wherein the diamond engagement surface is convex.

Embodiment 56. The tubular of any of embodiments 33 to 53, wherein the diamond engagement surface is concave.

Embodiment 57. The tubular of any of embodiments 33 to 56, wherein the polycrystalline diamond element includes thermally stable polycrystalline diamond.

Embodiment 58. The tubular of any of embodiments 33 to 56, wherein the polycrystalline diamond element includes polycrystalline diamond compact.

Embodiment 59. The tubular of any of embodiments 33 to 58, wherein the diamond engagement surface is lapped, polished, highly lapped or highly polished.

Embodiment 60. The tubular of any of embodiments 33 to 59, wherein the diamond engagement surface has a surface finish of at most 20 μin.

Embodiment 61. A tubular engagement interface for interfacing the engagement of two different tubulars, the tubular engagement interface including: a body, the body including a body engagement surface; and a polycrystalline diamond element coupled with the body, the polycrystalline diamond element including a diamond engagement surface.

Embodiment 62. The tubular engagement interface of embodiment 61, wherein the polycrystalline diamond element is positioned on the body such that at least a portion of the diamond engagement surface is positioned above the body engagement surface.

Embodiment 63. The tubular engagement interface of embodiment 61, wherein the polycrystalline diamond element is positioned on the body such that at least a portion of the diamond engagement surface is flush with the body engagement surface.

Embodiment 64. The tubular engagement interface of embodiment 60, wherein the polycrystalline diamond element is positioned on the body such that an entirety of the diamond engagement surface is positioned below the body engagement surface.

Embodiment 65. The tubular engagement interface of any of embodiments 61 to 64, wherein the tubular engagement interface includes a drill pipe protector.

Embodiment 66. The tubular engagement interface of embodiment 65, wherein the body at least partially forms a frame of the drill pipe protector, the frame defining a hollow, and wherein the polycrystalline diamond element is coupled with the frame.

Embodiment 67. The tubular engagement interface of any of embodiments 61 to 64, wherein the tubular engagement interface includes a sucker rod guide.

Embodiment 68. The tubular engagement interface of any of embodiments 61 to 67, wherein the body includes a socket, and wherein the polycrystalline diamond element is positioned within the socket.

Embodiment 69. The tubular engagement interface of any of embodiments 61 to 68, wherein the polycrystalline diamond element is embedded within the body.

Embodiment 70. The tubular engagement interface of any of embodiments 61 to 69, wherein the polycrystalline diamond element is attached to the body.

Embodiment 71. The tubular engagement interface of any of embodiments 61 to 70, wherein the body includes a polymer that is molded over at least a portion of the polycrystalline diamond element.

Embodiment 72. The tubular engagement interface of any of embodiments 61 to 71, wherein the body includes a metal.

Embodiment 73. The tubular engagement interface of embodiment 72, wherein the body includes steel.

Embodiment 74. The tubular engagement interface of any of embodiments 61 to 73, wherein the body includes a polymer.

Embodiment 75. The tubular engagement interface of embodiment 74, wherein the body includes a plastic or an elastomer.

Embodiment 76. The tubular engagement interface of embodiment 75, wherein the body includes nylon, polyurethane, polyamide, or polyether ether ketone (PEEK).

Embodiment 77. The tubular engagement interface of any of embodiments 61 to 76, wherein the diamond engagement surface planar with radiused edges.

Embodiment 78. The tubular engagement interface of any of embodiments 61 to 76, wherein the diamond engagement surface is convex.

Embodiment 79. The tubular engagement interface of any of embodiments 61 to 76, wherein the diamond engagement surface is concave.

Embodiment 80. The tubular engagement interface of any of embodiments 61 to 79, wherein the polycrystalline diamond element includes thermally stable polycrystalline diamond.

Embodiment 81. The tubular engagement interface of any of embodiments 61 to 79, wherein the polycrystalline diamond element includes polycrystalline diamond compact.

Embodiment 82. The tubular engagement interface of any of embodiments 61 to 81, wherein the diamond engagement surface is lapped, polished, highly lapped or highly polished.

Embodiment 83. The tubular engagement interface of any of embodiments 61 to 82, wherein the diamond engagement surface has a surface finish of at most 20 μin.

Embodiment 84. A method of engaging tubulars, the method including: movably engaging a second tubular within a hollow of a first tubular, the first tubular including an outer wall and an inner wall that at least partially defines the hollow, the second tubular including an outer wall; and interfacing the engagement between the outer wall of the second tubular and the inner wall of the first tubular with a tubular engagement interface, the tubular engagement interface including a body, the body including a body engagement surface, and a polycrystalline diamond element coupled with the body, the polycrystalline diamond element including a diamond engagement surface; wherein interfacing the engagement includes engaging the body engagement surface, the diamond engagement surface, or combinations thereof with an opposing engagement surface of either the second tubular or the first tubular.

Embodiment 85. The method of embodiment 84, wherein interfacing the engagement includes coupling the tubular engagement interface with the inner wall of the first tubular, and wherein movably engaging the second tubular within the hollow of the first tubular includes positioning the second tubular such that the body engagement surface, the diamond engagement surface, or combinations thereof are engaged with the outer wall of the second tubular, wherein the outer wall of the second tubular is the opposing engagement surface.

Embodiment 86. The method of embodiment 84, wherein interfacing the engagement includes coupling the tubular engagement interface with the outer wall of the second tubular, and wherein movably engaging the second tubular within the hollow of the first tubular includes positioning the second tubular such that the body engagement surface, the diamond engagement surface, or combinations thereof are engaged with the inner wall of the first tubular, wherein the inner wall of the first tubular is the opposing engagement surface.

Embodiment 87. The method of any of embodiments 84 to 86, wherein movably engaging the second tubular within the hollow of the first tubular includes slidingly engaging the second tubular within the first tubular.

Embodiment 88. The method of any of embodiments 84 to 87, wherein movably engaging the second tubular within the hollow of the first tubular includes rotatably engaging the second tubular within the first tubular.

Embodiment 89. The method of any of embodiments 84 to 88, wherein interfacing the engagement includes engaging the body engagement surface with the opposing engagement surface of either the second tubular or the first tubular.

Embodiment 90. The method of embodiment 89, wherein the diamond engagement surface is engaged with the opposing engagement surface of either the second tubular or the first tubular only after the occurrence of wear to the body engagement surface.

Embodiment 91. The method of embodiment 90, wherein the polycrystalline diamond element is positioned on the body such with the diamond engagement surface is positioned below the body engagement surface.

Embodiment 92. The method of any of embodiments 84 to 88, wherein interfacing the engagement includes simultaneously engaging the body engagement surface and the diamond engagement surface with the opposing engagement surface of either the second tubular or the first tubular.

Embodiment 93. The method of embodiment 92, wherein the polycrystalline diamond element is positioned on the body such with at least a portion of the diamond engagement surface is flush with the body engagement surface.

Embodiment 94. The method of any of embodiments 84 to 88, wherein interfacing the engagement includes engaging the diamond engagement surface with the opposing engagement surface of either the second tubular or the first tubular.

Embodiment 95. The method of embodiment 94, wherein the polycrystalline diamond element is positioned on the body such with at least a portion of the diamond engagement surface is positioned above the body engagement surface.

Embodiment 96. The method of any of embodiments 84 to 95, wherein the first tubular includes wellbore casing, wherein the second tubular includes drill pipe, and wherein the tubular engagement interface includes a drill pipe protector coupled with the drill pipe.

Embodiment 97. The method of embodiment 96, wherein the body at least partially forms a frame of the drill pipe protector, the frame defining a hollow, wherein the second tubular is positioned within the hollow of the body such that the drill pipe protector at least partially surrounds at least a portion of the second tubular, and wherein the polycrystalline diamond element is coupled with the frame and is positioned to engage with the wellbore casing.

Embodiment 98. The method of any of embodiments 84 to 95, wherein the first tubular includes production tubing in a wellbore, wherein the second tubular includes a sucker rod, and wherein the tubular engagement interface includes a sucker rod guide coupled with the sucker rod.

Embodiment 99. The method of any of embodiments 84 to 95, wherein the second tubular is a solid tubular.

Embodiment 100. The method of any of embodiments 84 to 95, wherein the second tubular is a hollow tubular.

Embodiment 101. The method of any of embodiments 84 to 100, wherein the opposing engagement surface includes a diamond reactive material.

Embodiment 102. The method of any of embodiments 84 to 101, wherein the opposing engagement surface includes steel.

Embodiment 103. The method of any of embodiments 84 102, further including coupling the tubular engagement interface with the first or second tubular prior to movably engaging the first and second tubular.

Embodiment 104. The method of embodiment 103, wherein coupling the tubular engagement interface with the first or second tubular includes positioning the polycrystalline diamond element within a socket in the body.

Embodiment 105. The method of embodiment 103, wherein coupling the tubular engagement interface with the first or second tubular includes embedding the polycrystalline diamond element within the body.

Embodiment 106. The method of embodiment 103, wherein coupling the tubular engagement interface with the first or second tubular includes attaching the polycrystalline diamond element to the body.

Embodiment 107. The method of embodiment 103, wherein the body includes a polymer, and wherein coupling the tubular engagement interface with the first or second tubular includes molding the polymer over at least a portion of the polycrystalline diamond element.

Embodiment 108. The method of any of embodiments 84 to 107, wherein the body includes a metal.

Embodiment 109. The method of embodiment 108, wherein the body com includes steel.

Embodiment 110. The method of any of embodiments 84 to 109, wherein the body includes a polymer.

Embodiment 111. The method of embodiment 110, wherein the body includes a plastic or an elastomer.

Embodiment 112. The method of embodiment 111, wherein the body includes nylon, polyurethane, polyamide, or polyether ether ketone (PEEK).

Embodiment 113. The method of any of embodiments 84 to 112, wherein the diamond engagement surface planar with radiused edges.

Embodiment 114. The method of any of embodiments 84 to 112, wherein the diamond engagement surface is convex.

Embodiment 115. The method of any of embodiments 84 to 112, wherein the diamond engagement surface is concave.

Embodiment 116. The method of any of embodiments 84 to 115, wherein the polycrystalline diamond element includes thermally stable polycrystalline diamond.

Embodiment 117. The method of any of embodiments 84 to 115, wherein the polycrystalline diamond element includes polycrystalline diamond compact.

Embodiment 118. The method of any of embodiments 84 to 117, further including polishing or lapping the diamond engagement surface.

Embodiment 119. The method of any of embodiments 84 to 118, wherein the diamond engagement surface has a surface finish of at most 20 μin.

Embodiment 120. The method of any of embodiments 84 to 119, further including, after use of the polycrystalline diamond element in a downhole environment, recovering the polycrystalline diamond element from the tubular engagement interface and reusing the polycrystalline diamond element in new or refurbished tubular engagement interface.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A tubular assembly, the assembly comprising:

a first tubular including an outer wall, an inner wall, and a hollow that is at least partially defined by the inner wall;

a second tubular including an outer wall, wherein the second tubular is movably engaged with the first tubular, such that the second tubular is at least partially positioned within the hollow of the first tubular;

a tubular engagement interface comprising a body, the body including a body engagement surface, and a polycrystalline diamond element coupled with the body, the polycrystalline diamond element including a diamond engagement surface;

wherein the tubular engagement interface is coupled with one of the first or second tubulars, such that the diamond engagement surface slidingly engages with an opposing engagement surface of the other of the first or second tubulars, and wherein the opposing engagement surface is a metal surface, the metal surface comprising a metal that comprises at least 2 wt. % of a diamond solvent or diamond catalyst based on a total weight of the metal.

2. The assembly of claim 1, wherein the tubular engagement interface is coupled with the inner wall of the first tubular such that is slidingly engaged with the opposing engagement surface of the outer wall of the second tubular.

3. The assembly of claim 1, wherein the tubular engagement interface is coupled with the outer wall of the second tubular such that the diamond engagement surface is slidingly engaged with the opposing engagement surface of the inner wall of the first tubular.

4. The assembly of claim 3, wherein the first tubular comprises wellbore casing, wherein the second tubular comprises drill pipe, and wherein the tubular engagement interface comprises a drill pipe protector coupled with the drill pipe.

5. The assembly of claim 3, wherein the first tubular comprises production tubing in a wellbore, wherein the second tubular comprises a sucker rod, and wherein the tubular engagement interface comprises a sucker rod guide coupled with the sucker rod.

6. The assembly of claim 1, wherein the second tubular is slidingly engaged within the first tubular, rotatably engaged within the first tubular, or combinations thereof.

7. The assembly of claim 1, wherein the polycrystalline diamond element is positioned on the body such that at least a portion of the diamond engagement surface is positioned above the body engagement surface, such that the diamond engagement surface is slidingly engaged with the opposing engagement surface.

8. The assembly of claim 1, wherein the polycrystalline diamond element is positioned on the body such that at least a portion of the diamond engagement surface is flush with the body engagement surface, such that the diamond engagement surface and the body engagement surface are slidingly engaged with the opposing engagement surface.

9. The assembly of claim 1, wherein the polycrystalline diamond element is positioned on the body such that the diamond engagement surface is positioned below the body engagement surface, such that the body engagement surface is slidingly engaged with the opposing engagement surface.

10. The assembly of claim 1, wherein the metal comprises iron or an alloy thereof, titanium or an alloy thereof, cobalt or an alloy thereof, nickel or an alloy thereof, ruthenium or an alloy thereof, rhodium or an alloy thereof, palladium or an alloy thereof, chromium or an alloy thereof, manganese or an alloy thereof, copper or an alloy thereof, or tantalum or an alloy thereof.

11. The assembly of claim 1, wherein the diamond engagement surface has a surface finish of at most 20 μin.

12. The assembly of claim 1, wherein the metal comprises from 45 to 100 wt. % of the diamond solvent or diamond catalyst based on the total weight of the metal.

13. The assembly of claim 1, wherein the metal surface is softer than tungsten carbide.

14. A method of engaging tubulars, the method comprising:

movably engaging a second tubular within a hollow of a first tubular, the first tubular including an outer wall and an inner wall that at least partially defines the hollow, the second tubular including an outer wall; and interfacing the engagement between the outer wall of the second tubular and the inner wall of the first tubular with a tubular engagement interface, the tubular engagement interface comprising a body, the body including a body engagement surface, and a polycrystalline diamond element coupled with the body, the polycrystalline diamond element including a diamond engagement surface;

wherein interfacing the engagement includes slidingly engaging the diamond engagement surface with an opposing engagement surface of either the second tubular or the first tubular, and wherein the opposing engagement surface is a metal surface, the metal surface comprising a metal that comprises at least 2 wt. % of a diamond solvent or diamond catalyst based on a total weight of the metal.

15. The method of claim 14, wherein interfacing the engagement includes coupling the tubular engagement interface with the inner wall of the first tubular, and wherein movably engaging the second tubular within the hollow of the first tubular includes positioning the second tubular such that the diamond engagement surface is slidingly engaged with the outer wall of the second tubular, wherein the outer wall of the second tubular is the opposing engagement surface.

16. The method of claim 14, wherein interfacing the engagement includes coupling the tubular engagement interface with the outer wall of the second tubular, and wherein movably engaging the second tubular within the hollow of the first tubular includes positioning the second tubular such that the diamond engagement surface is slidingly engaged with the inner wall of the first tubular, wherein the inner wall of the first tubular is the opposing engagement surface.

17. The method of claim 14, wherein movably engaging the second tubular within the hollow of the first tubular includes slidingly engaging the second tubular within the first tubular, rotatably engaging the second tubular within the first tubular, or combinations thereof.

18. The method of claim 14, wherein the diamond engagement surface is slidingly engaged with the opposing engagement surface of either the second tubular or the first tubular only after the occurrence of wear to the body engagement surface.

19. The method of claim 14, wherein interfacing the engagement includes simultaneously slidingly engaging the body engagement surface and the diamond engagement surface with the opposing engagement surface of either the second tubular or the first tubular.

20. The method of claim 14, wherein interfacing the engagement includes slidingly engaging the diamond engagement surface with the opposing engagement surface of either the second tubular or the first tubular without engaging the body engagement surface with the opposing engagement surface of either the second tubular or the first tubular.

21. The method of claim 14, wherein the first tubular comprises wellbore casing, wherein the second tubular comprises drill pipe, and wherein the tubular engagement interface comprises a drill pipe protector coupled with the drill pipe; or wherein the first tubular comprises production tubing in a wellbore, wherein the second tubular comprises a sucker rod, and wherein the tubular engagement interface comprises a sucker rod guide coupled with the sucker rod.

22. A tubular assembly, the assembly comprising:

a first tubular including an outer wall, an inner wall, and a hollow that is at least partially defined by the inner wall;

a second tubular including an outer wall, wherein the second tubular is movably engaged with the first tubular, such that the second tubular is at least partially positioned within the hollow of the first tubular;

a tubular engagement interface comprising a body, the body including a body engagement surface, and a polycrystalline diamond element coupled with the body, the polycrystalline diamond element including a diamond engagement surface;

wherein the tubular engagement interface is coupled with one of the first or second tubulars, such that the diamond engagement surface slidingly engages with an opposing engagement surface of the other of the first or second tubulars, and wherein the opposing engagement surface is a metal surface, the metal surface comprising a at least 2 wt. % of iron or an alloy thereof, titanium or an alloy thereof, cobalt or an alloy thereof, nickel or an alloy thereof, ruthenium or an alloy thereof, rhodium or an alloy thereof, palladium or an alloy thereof, chromium or an alloy thereof, manganese or an alloy thereof, copper or an alloy thereof, or tantalum or an alloy thereof based on a total weight of the metal.

23. The assembly of claim 22, wherein the first tubular comprises wellbore casing, wherein the second tubular comprises drill pipe, and wherein the tubular engagement interface comprises a drill pipe protector coupled with the drill pipe.

24. The assembly of claim 22, wherein the first tubular comprises production tubing in a wellbore, wherein the second tubular comprises a sucker rod, and wherein the tubular engagement interface comprises a sucker rod guide coupled with the sucker rod.

25. The assembly of claim 22, wherein the metal surface comprises at least 2 wt. % of iron or an alloy thereof or titanium or an alloy thereof.

26. The assembly of claim 22, wherein the metal surface comprises an iron-based superalloy, a cobalt-based superalloy, or a nickel-based superalloy.

27. A tubular assembly, the assembly comprising:

a first tubular;

a second tubular movably engaged with the first tubular;

a polycrystalline diamond having a diamond engagement surface, wherein the polycrystalline diamond is coupled with one of the first or second tubulars, such that the diamond engagement surface slidingly engages with an opposing engagement surface of the other of the first or second tubulars, and wherein the opposing engagement surface is a metal surface, the metal surface comprising a metal comprising at least 2 wt. % of a diamond catalyst or diamond solvent based on a total weight of the metal.

28. The assembly of claim 27, wherein the diamond catalyst or diamond solvent is iron or an alloy thereof, titanium or an alloy thereof, nickel or an alloy thereof, ruthenium or an alloy thereof, rhodium or an alloy thereof, palladium or an alloy thereof, chromium or an alloy thereof, manganese or an alloy thereof, copper or an alloy thereof, or tantalum or an alloy thereof.

29. The assembly of claim 27, wherein the polycrystalline diamond is coupled with an outer wall of the second tubular, and wherein the opposing engagement surface is a surface of an inner wall of the first tubular; and wherein the first tubular comprises wellbore casing, the second tubular comprises drill pipe having a drill pipe protector thereon, and the polycrystalline diamond is coupled with the drill pipe protector; or wherein the first tubular comprises production tubing in a wellbore, the second tubular comprises a sucker rod having a sucker rod guide coupled thereon, and the polycrystalline diamond is coupled with the sucker rod guide.

* * * * *